US007484732B2

(12) United States Patent
Adams

(10) Patent No.: US 7,484,732 B2
(45) Date of Patent: Feb. 3, 2009

(54) CARD GAME

(76) Inventor: Michael Edward Adams, 90 Windsor Dr., Pine Brook, NJ (US) 07058

( * ) Notice: Subject to any disclaimer, the term of this patent is extended or adjusted under 35 U.S.C. 154(b) by 0 days.

(21) Appl. No.: 11/133,623

(22) Filed: May 20, 2005

(65) Prior Publication Data

US 2006/0279043 A1 Dec. 14, 2006

(51) Int. Cl.
*A63F 1/10* (2006.01)

(52) U.S. Cl. ..... 273/157 R; 273/150; 40/124.01

(58) Field of Classification Search ..... 273/292, 273/293, 148 R, 309, 150, 151, 148 A, 153 R, 273/156, 157 R; 40/124.01, 124.02, 124.04, 40/371, 373, 377, 124
See application file for complete search history.

(56) References Cited

U.S. PATENT DOCUMENTS

| | | | | | |
|---|---|---|---|---|---|
| 1,828,735 | A | * | 10/1931 | William et al. | 273/150 |
| 2,694,576 | A | * | 11/1954 | Ivey | 273/150 |
| 2,717,156 | A | * | 9/1955 | Nelson | 273/248 |
| 2,818,262 | A | * | 12/1957 | Nanna | 273/150 |
| 3,339,296 | A | * | 9/1967 | Chuy | 434/331 |
| 3,620,535 | A | * | 11/1971 | Cerney et al. | 273/150 |
| 3,761,094 | A | * | 9/1973 | Belisle | 273/293 |
| 3,818,905 | A | * | 6/1974 | Lebold | 602/21 |
| 3,863,371 | A | * | 2/1975 | Shertenlieb | 40/124.2 |
| 3,937,472 | A | * | 2/1976 | Rice | 273/157 R |
| 4,073,494 | A | * | 2/1978 | McAdams | 273/150 |
| 4,666,163 | A | | 5/1987 | Hirschfeld | |
| 4,684,132 | A | * | 8/1987 | Wolford | 273/150 |
| 4,838,551 | A | | 6/1989 | Volpert | |
| 4,927,149 | A | * | 5/1990 | Bull | 273/150 |
| 5,056,793 | A | | 10/1991 | Sigle | |
| 5,221,094 | A | | 6/1993 | Hanson | |
| 5,339,547 | A | * | 8/1994 | Fogel | 40/124.01 |
| 5,393,066 | A | * | 2/1995 | Reinitz | 273/236 |
| 5,445,378 | A | * | 8/1995 | Cook | 273/150 |
| 5,590,880 | A | * | 1/1997 | Flam | 273/150 |
| 6,328,307 | B1 | * | 12/2001 | Saldana | 273/292 |
| 6,431,544 | B1 | * | 8/2002 | Kagami | 273/157 R |
| D493,199 | S | * | 7/2004 | Cowgill | D21/392 |

* cited by examiner

*Primary Examiner*—William M. Pierce
(74) *Attorney, Agent, or Firm*—Law Offices of Rita C. Chipperson, P.C.

(57) ABSTRACT

A method and apparatus for assembling one or more coherent images from a plurality of segments of the coherent image reproduced on parts, pieces, blocks, cards, or the like is disclosed. In one embodiment of the present invention, the face of each segment includes a portion of the resulting single coherent image. When all segments are correctly arranged and stacked, or overlapped, with the correct orientation, the visible images on the faces of the segments mesh to form one or more larger coherent images. A variety of plates or stands are disclosed to aid the player in stacking the segments and arranging them with the proper orientation during the reassembly process. Additionally, information or images may be included on the portions of the faces of each segment that are obscured by other segments when the segments are properly assembled, thereby allowing such games to have multiple uses.

39 Claims, 25 Drawing Sheets

CARD GAME

BACKGROUND OF THE INVENTION

Embodiments of the present invention generally relate to a method and apparatus for playing a game and displaying said game. More specifically, the present invention relates to a method and apparatus for playing a game that requires the player to assemble a set of cards to form an image, wherein said cards may optionally be assembled atop an apparatus that aids proper positioning and assembly of said cards, as well as display of the assembled cards.

Many systems and methods have been created to provide people with entertainment via puzzles and games that involve puzzles. Many such systems and methods involve reassembly of segments of an image to recreate an overall image. In its most simplistic form, some such systems and methods include reassembling square segments atop a support surface to create an image. One such system includes a support surface upon which the desired image (i.e., the image that is created when the puzzle is complete) is imprinted or otherwise placed to help the assembler properly piece together the puzzle. In some such systems, cards containing rectangular segments of the image are arranged on the support surface in rows and columns until the image depicted on the support surface is recreated. Alternatively, the cards may be arranged atop a surface other than the support surface. In this scenario, use of the support surface may be omitted or such surface may serve only as a memory aid. Additionally, the cards incorporated in such games may include a picture of the intended image on the back of the card to allow cards related to different puzzles to be distinguished from one another.

Similar games incorporating a support surface exist in which the cards may be affixed or held in place by the support surface. In some such games, the cards may be secured to the support surface by inserting them into slots included within the support surface. Some such games are assembled by first inserting the appropriate cards into the respective slots in the top row of each column. Thereafter, cards are inserted into the respective slots of the lower rows of each column such that they overlap the previously inserted cards. The resulting overall image is created from the visible portions of the inserted cards (i.e., the portions of the cards that are not overlapped by adjacent cards).

Some existing games require players to disassemble one or more puzzles. One such game includes an assembled puzzle image hidden behind an assembled concealing puzzle, wherein the concealing puzzle includes smaller puzzle pieces than the hidden puzzle. In one form, the hidden puzzle image is concealed by a puzzle that contains its own distinct image. In this game, the players take turns removing randomly selected pieces of the concealing puzzle to reveal portions of the concealed puzzle image. When one of the game players correctly guesses the concealed puzzle image, the game is ended and this player is deemed the winner. In more complex versions of such games, the winner must correctly answer a question contained in the concealed puzzle image in addition to identifying the puzzle image.

Another similar game that requires players to disassemble one or more concealing puzzles includes a specific method for removing the pieces of such a puzzle. In one such game, the pieces of the concealing puzzle are square or rectangular, opaque pieces that lie atop a transparent window that protects the surface of the concealed image. Additionally, each piece of the concealing puzzle is color-coded, wherein each color corresponds to a category of questions. To play this game, players take turns choosing pieces of the concealing puzzle.

After a player selects a piece, the respective player is asked a question that corresponds to the question category associated with the color of the selected puzzle piece. If the player correctly answers the question, the puzzle piece is removed, revealing a portion of the concealed image. Each player continues to take a turn until one of the players correctly identifies the concealed image, thereby winning the game. In some such games, each piece of the concealing puzzle is assigned a monetary value based on its color to allow the players to earn points as the game progresses.

SUMMARY OF THE INVENTION

Apparatus and methods for assembling or reassembling one or more coherent images from a plurality of segments of the coherent image, wherein said segments are reproduced on parts, pieces, blocks, cards, or the like, are provided in one aspect of the present invention. In one embodiment of the present invention, a set of cards such as, but not limited to, a traditional deck of cards, is provided such that the face of each card includes a portion of a single coherent image. When a player arranges each of the cards of the set in the correct overlapping order with the correct orientation, the images on the visible portions of the card faces mesh together to form one or more larger coherent images. Optionally, such cards may be fixed in an immovable position to allow the resulting image to be displayed.

In some embodiments of the present invention, the topmost card (i.e., the card that lies on top of all other cards when the final coherent image has been achieved) contributes the entire face of the topmost card to the resulting coherent image, whereas all other cards (e.g., the base card and intermediate cards) contribute only a portion of the face of the respective card to the final resulting image. That is, the portions of the base and intermediate cards that are not visible in the resulting coherent image are obscured by the overlapping edges of adjacent cards. In this embodiment of the present invention, all cards except the topmost card include only a small and unique portion of the final complete image. Consequently, the topmost card is unique in that it contributes its entire face to the resulting image making its contribution to such image much greater than the intermediate and base cards. Starting assembly of the cards with the base card and completing such assembly with the topmost card provides the player with the greatest sense of accomplishment upon completion of the assembly since the topmost card includes the most significant portion of the resulting image.

In some embodiments of the present invention, the face of each card includes a unique portion of the resulting single coherent image. That is, no two cards of the set of cards include exactly the same image. In such embodiments of the present invention, the method of assembling or reassembling the resulting coherent image that is provided by the present invention requires simply starting with the base card (i.e., the card that lies beneath all other cards when the final coherent image has been achieved) and matching each adjacent card on a one-by-one basis until all intermediate and topmost cards have been assembled, thereby achieving the final resulting image.

Although no two cards include identical images in the aforementioned embodiment of the present invention, alternate, more complex embodiments of the present invention are envisioned in which the images located on the faces of each card, or portions thereof, are wholly or partially duplicated to make it more or less difficult for the player to match adjacent, overlapping cards. In other words, in these embodiments, there may exist more than one card that appears to match another card, and the player will have to match several other subsequent cards before learning that the originally selected card was incorrect. Such embodiments are intended to increase the enjoyment for more experienced players of the present invention. In either of the aforementioned embodiments, the cards are matched solely by side-by-side matching of randomly selected cards until the correct card is discovered (i.e., the visual information on the card aligns in the correct relative format to the visual information included on the previous card with no overlapping or omission of the visual image).

In one optional aspect of the present invention, the portions of the card faces that are obscured by the overlapping edges of adjacent cards when the card assembly is complete are imprinted or otherwise marked with information or images either related or unrelated to the resulting coherent image. In one such embodiment, the obscured portions of the card faces include complete or partial segments of the final resulting image that are intended to increase or decrease the complexity of matching adjacent, overlapping cards. For example, the portion of the card faces that are visible in the resulting image may be extended to form a complete image that encompasses the entire face of the card. In such an embodiment, all intermediate and base cards are similar to the topmost card in that the entire face of the card includes an image, however, the images vary, at least slightly, from card to card.

Since the image on each card is created from the visible segment of the image when all cards are assembled, the images on adjacent cards may overlap. This overlap provides clues that a player may use when performing side-by-side matching of the cards since the more similar images are located closer to each other in the final arrangement. Additionally, the level of difficulty of assembling the final coherent image may be increased or decreased by adjusting the quantity of duplicated information on adjacent cards. However, many embodiments of the present invention do not require any evaluation of the card faces other than the side-by-side comparison discussed herein. In such embodiments, comparison of the quantity of duplicated information on adjacent cards serves as an aide to assembling the final coherent image, but is not a requirement thereof.

In embodiments of the present invention that include full images on the faces of each card in the deck, any of the cards may be chosen to be the base card. In such embodiments, each time a different base card is selected, a different rotation of the coherent image results. This rotation causes the topmost card to change, which in turn may greatly change the appearance of the final coherent image, thereby allowing a player to replay the game many times without boredom since a different result is achieved each time. Each time a different base card is selected, a different topmost card results.

Alternative embodiments of the present invention are envisioned in which the obscured portion of the card faces include other information not related to the final resulting image. For example, in one embodiment of the present invention, fifty-four cards are included in the set and the obscured portion of each of the cards, with the exception of the topmost card, includes information related to a respective card of a standard deck. In other words, the totality of the cards includes two jokers as well as the four standard suits in a typical deck of cards (i.e., diamonds, hearts, spades, and clubs), wherein each of the latter includes the thirteen standard values (i.e., ace, two through ten, jack, queen, and king). Since the topmost card does not have an obscured area, such card typically serves as one of the two jokers. In this embodiment of the present invention, the utility and enjoyment of the present invention is increased by allowing the set of cards to be assembled as a single coherent image or disassembled for use as a standard deck of cards. In some embodiments, such cards may be shuffled, dealt, and played in a conventional fashion according to the rules of either existing games (e.g., poker, solitaire, spades, hearts, rummy, etc.) or yet to be invented card games. Also, in such embodiments, the values on the obscured portion of each card may be used to score a game having assembly or reassembly of the single coherent image as its goal.

Rather than including the numbers, suits, jokers, etc. that occur in a standard deck of playing cards, other card designs may be employed within the obscured portions of the card faces. For example, such obscured portions may be designed to resemble cards used to play traditional games such as Old Maid, Crazy Eights, Rook®, Flinch®, UNO®, memory, and the like. Or, such obscured areas may include questions, multiplication tables, or other similar information to allow the cards to be alternatively used as educational flash cards. In yet another embodiment, the obscured areas of each card may include the letters of the alphabet, numbers, or other information having a sequential order. In such an embodiment, arranging the cards in the respective sequential order allows the player to easily assemble a single coherent image. Such embodiments decrease the level of complexity associated with the present invention to allow it to be played by individuals such as young children or those having poor eyesight. Alternatively, the obscured portions of the card faces may be left blank.

Furthermore, the back of each card (i.e., the side of the card located opposite the face of the card) may also include visual or other information. For example, the back of each card may include the graphics of a respective one of a standard deck of cards or a special deck of cards (e.g., Old Maid, Crazy Eights, Rook®, Flinch®, UNO®, etc.). Alternatively, the backs of each card could contain a portion of a second single coherent image to allow one set of cards to be assembled to create either of two, distinct coherent images. In yet another embodiment, the card backs may include information that is either related to or unrelated to the final resulting image and is included to increase the enjoyment, educational value, or utility of the card game (e.g., such information may create flash cards that allow children to study various subjects). And in still another embodiment, each card may include subsections of four distinct coherent images, essentially creating four distinct games as described herein, which greatly increases the amusement value of a single set of cards.

In addition to the various segment embodiments of the present invention, an apparatus for playing such a game is also provided. In many embodiments, one or more of a variety of plates or stands are incorporated to aid the player in arranging the cards in the proper orientation during the reassembly process. Such plates and stands may include mechanisms for locking the image segments (e.g., cards) in an immovable position upon finalization of the assembly or reassembly. Locking the segments in such a position allows the resulting image to be more easily stored, transported, and displayed.

Specifically, in one embodiment of the present invention, the card game includes, inter alia, a base, shaft, knob, stop, plate, and post for removably attaching the segments at a single anchor point on each segment. In this embodiment, the anchor point for each segment is an aperture in the segment that is passed over a post that protrudes from the plate. After all segments are passed over and properly positioned with respect to the post, a stop and knob combination may be further passed over the post and threaded thereto to hold the segments in an immovable position. In some such embodiments, the apertures are identically located in the lower left corner of each segment allowing the segment to be arranged radially about the post possibly resulting in a circular coherent image.

The plate or stand may additionally include recesses that provide further support or orientation of the segments. These recesses allow an edge of the respective segment to be positioned along an interior wall of the recess to minimize the possibility that the segment moves from the desired position. Some embodiments of the present invention envision a dedicated recess for each segment, while other embodiments envision a recess for only a portion of the segments. Similarly, the stop may include one or more recesses that act in a similar manner. However, such stop recesses primarily provide support for the faces of the cards, whereas the plate or stand recesses primarily provide support for the backs of the cards.

Multiple anchor points are provided in some embodiments of the present invention. Some such anchor points include arms that extend from the plate or stand around a corner or edge of one or more segments, allowing the corners or edges of such segments to be inserted into recesses contained within the arms. In these embodiments, the stop discussed above may not be required as the secondary, tertiary, etc. anchor points help to render the segments immovable. However, stops may be included in any embodiment of the present invention regardless of the quantity of included anchor points.

In yet another embodiment of the present invention, the perimeter of the plate or stand is larger than the perimeter of the resulting coherent image. In these embodiments, recesses of sufficient size to fit the entire segment may be provided. Consequently, all edges of one or more segments may be supported by the single plate or stand. While the embodiments of the present invention described herein discuss one or two anchor points, other embodiments envision anchoring of one or more segments via three or more points.

One or more signaling devices are incorporated in some embodiments of the present invention such that during the assembling or reassembling of the resulting coherent image, a player receives a signal whenever one or more of the segments have been placed in the incorrect position or orientation. This signal may occur automatically or may be activated by the player via a button or other similar trigger. The signal may be virtually any signal such as a steady light, a flashing light, a single sound, a continuous sound, a repeating sound, a vibration of a portion of the game, or the like without departing from the spirit of the present invention.

Alternatively, occurrence of such a signal may indicate a variation in play of the card game according to a set of predefined game rules. Or, occurrence of such a signal may indicate a change in turn from a first player to a second player, or may indicate the end of the game. For example, upon a change in turn, the new player may undertake assembly of the final coherent image. Or, occurrence of such a signal may indicate a change in point value or role for one or more game segments. Many roles may be attributed to the occurrence of such a signal without departing from the scope of the present invention.

A method for assembling the resulting coherent image among any number of players with respect to a signaling device is also provided by the present invention. First, each player consecutively selects a card and places it in a selected position atop a single segment holder such as a plate or a stand. In this embodiment, the signaling device may be activated automatically whenever a card is placed in the correct position. If the card has been correctly placed, the player who placed the card scores a point, and play passes to the next player. However, if the card placement is incorrect, a point is not awarded, or may be deducted for the erring player. In this manner, points are tallied to determine a winner. In one such embodiment of the present invention, each card includes a distinct, hidden magnetic imprint in the corner of the card. Also, each card recess includes an embedded magnetic sensor capable of reading the magnetic imprint of a card inserted within the respective recess to determine whether the inserted card is the correct card. However, other embodiments of sensing cards may be substituted without departing from the scope of the present invention.

Incorporation of a signaling device within the card game is likely to increase the amusement value of the present invention for individuals who have impaired sight. Additionally, inclusion of a signaling device may allow more difficult games to be created by making it more feasible to design games having far more complicated and indecipherable images, such as abstract images. For example, more challenging images may be introduced having segments that very closely resemble other segments since the signaling feature will ultimately determine the accuracy of the placement of each card.

Other objects, features, and characteristics of the present invention, as well as the methods of operation and functions of the related elements of the structure, and the combination of parts and economies of manufacture, will become more apparent upon consideration of the following detailed description with reference to the accompanying drawings, all of which form a part of this specification.

BRIEF DESCRIPTION OF THE DRAWINGS

A further understanding of the present invention can be obtained by reference to the embodiments set forth in the illustrations of the accompanying drawings. Although the illustrated embodiments are exemplary of systems for carrying out the present invention, both the organization and method of operation of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the invention.

DETAILED DESCRIPTION

As required, a detailed illustrative embodiment of the present invention is disclosed herein. However, techniques, systems and operating structures in accordance with the present invention may be embodied in a wide variety of forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein, which define the scope of the present invention. The following presents a detailed description of one embodiment (as well as some alternative embodiments) of the present invention.

Figure 1:
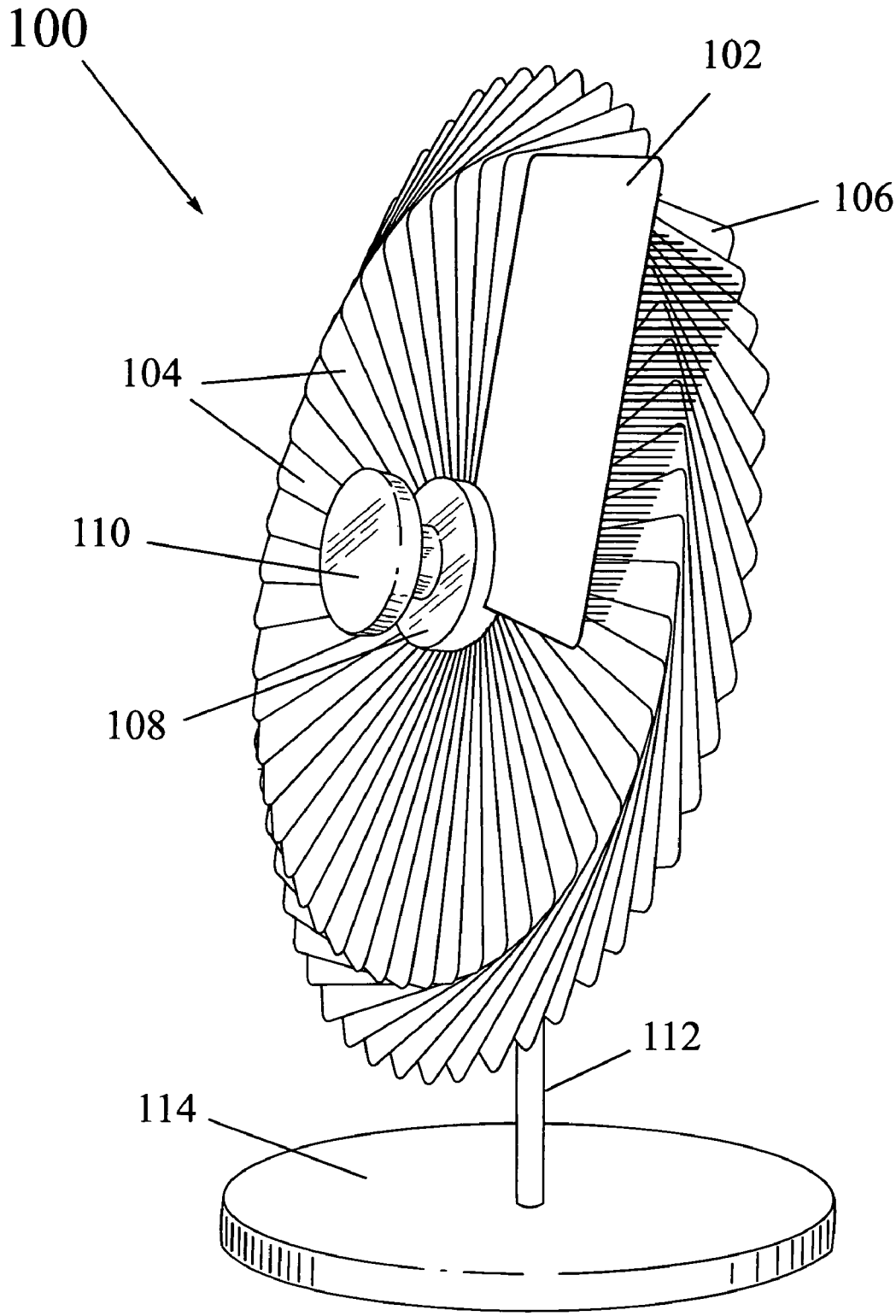
FIG. 1 depicts an angled, front view of an assembled card game in accordance with one embodiment of the present invention including, inter alia, cards, knob, stop, base, and shaft.
Figure 2:
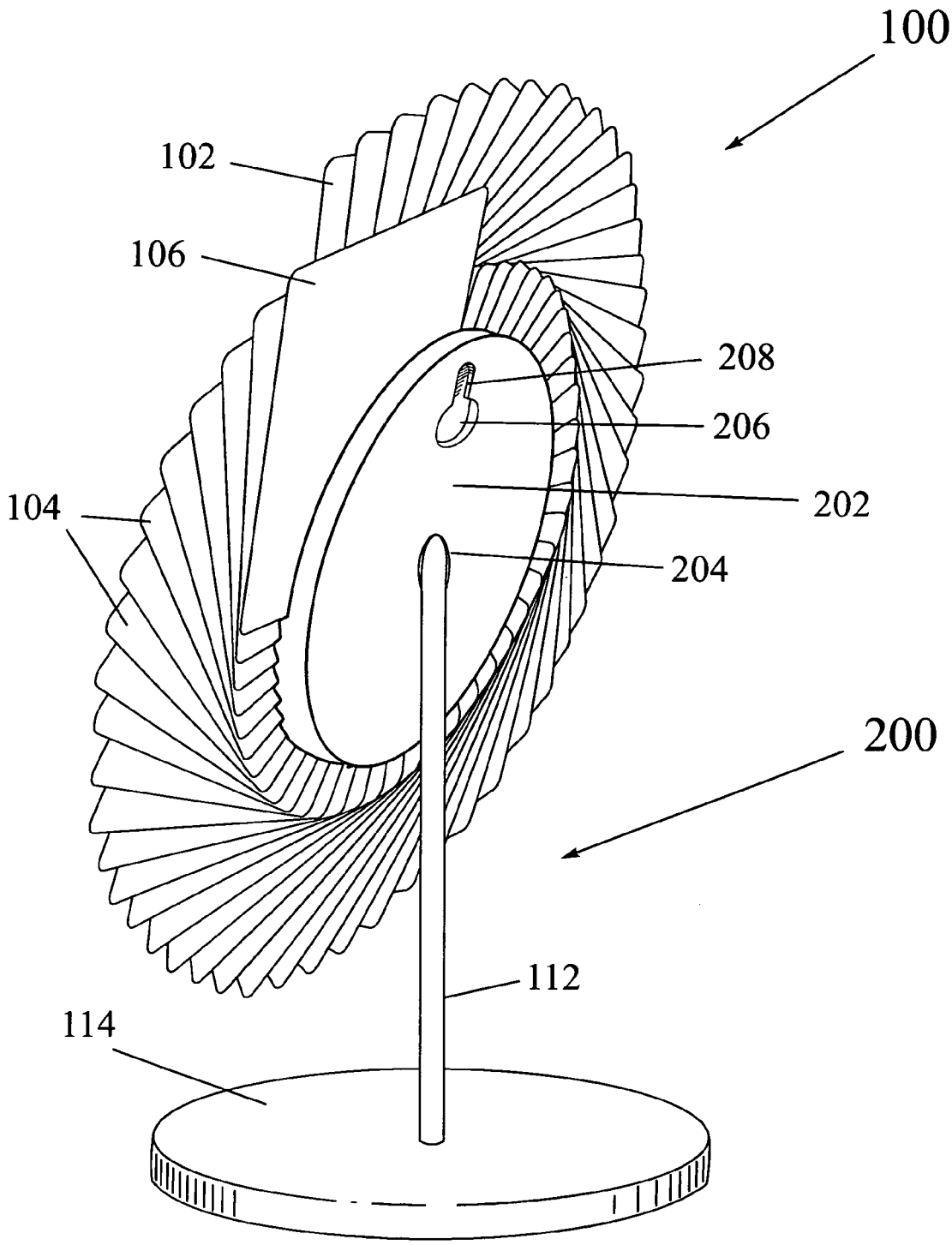
FIG. 2 depicts an angled, rear view of the assembled card game illustrated in FIG. 1 in accordance with one embodiment of the present invention including, inter alia, a plate having plate recesses, a support aperture, and a shaft aperture.

Referring first to FIG. 1, illustrated is an angled front view of an assembled card game 100 in accordance with an embodiment of the present invention. In the depicted embodiment, one topmost card 102, fifty-two intermediate cards 104, and one base card 106 are removably attached to plate 202 (FIG. 2). The total quantity of topmost, intermediate, and base cards, 102, 104, and 106, respectively, is equivalent to the number of cards in a standard deck of cards (i.e., fifty-four cards). Such a quantity allows the combination of topmost card 102, intermediate cards 104, and base card 106 to include two jokers as well as the four standard suits in a typical deck of cards (i.e., diamonds, hearts, spades, and clubs), wherein each of the latter includes the thirteen standard values (i.e., ace, two through ten, jack, queen, and king). Consequently, in some embodiments of the invention, whenever topmost, intermediate, and base cards 102, 104, and 106, respectively, are disengaged from plate 202, they may be used to play alternate card games requiring a standard deck of cards such as poker, solitaire, spades, hearts, rummy, or the like.

Embodiments of the present invention are envisioned having quantities of cards other than fifty-four without departing from the scope of the present invention. For example, card game 100 may be designed with fewer cards to allow topmost, intermediate, and base cards, 102, 104, and 106, respectively, to be used to play games typically requiring a lesser quantity of cards such as Old Maid, Crazy Eights, or the like, whenever such cards are not attached to, or are not being arranged for attachment to, plate 202. Alternatively, topmost card 102, intermediate cards 104, and base card 106 may be designed with greater than fifty-four cards to allow such cards to be used to play games typically requiring a large quantity of cards such as Rook®, Flinch®, UNO®, memory, or the like, whenever such cards are not attached to, or are not being arranged for attachment to, plate 202.

In lieu of using topmost, intermediate, and base cards, 102, 104, and 106, respectively, to play card games whenever such cards are not attached to, or are not being arranged for attachment to, plate 202, such cards may be used for other purposes. For example, each card may be an educational flash card including questions and corresponding answers.

In the embodiment of the present invention depicted in FIG. 1, the faces of topmost, intermediate, and base cards, 102,104, and 106, respectively, each include a distinct image that may be arranged in a circular, stacked manner to allow one coherent image such as image 400 (FIG. 4) to be created. In such an embodiment, topmost, intermediate, and base cards, 102, 104, and 106, respectively, are anchored to plate 202 at a single point via a mechanism such as stop 108 and knob 110, as discussed in greater detail below with respect to FIG. 3. This anchoring allows topmost, intermediate, and base cards, 102, 104, and 106, respectively, to be fixed in a vertical orientation such that the entire face of topmost card 102 and the edges of the faces of intermediate and base cards, 104 and 106, respectively, can be viewed simultaneously. Such anchoring allows the single coherent image created by successfully stacking and arranging topmost, intermediate, and base cards 102, 104, and 106, respectively, to be displayed in a stationary state such that the created image does not become distorted. Furthermore, as discussed in greater detail below with respect to FIG. 2, plate 202 accommodates display of the created image on a vertical surface and inclusion of a removably attached shaft 112 having an integral or removable base 114 allows the created image to be displayed on a horizontal surface.

Turning next to FIG. 2, depicted is an angled rear view of an assembled card game 100 including an angled rear view of stand 200. In the embodiment of the present invention depicted in FIG. 2, stand 200 includes shaft 112 and base 114. The lowermost end of shaft 112 may be permanently or removably attached to base 114, while the uppermost end of shaft 112 is permanently or removably inserted into and affixed to shaft aperture 204 included in plate 202. Inclusion of an aspect of the present invention such as stand 200 allows an assembled card game 100 to rest atop a table, shelf, or other flat or horizontal surface to facilitate display of an assembled card game 100.

Alternatively, when shaft 112 is removed from shaft aperture 204, an assembled card game 100 may be suspended from a wall or other vertical surface by inserting the head of a nail, screw, or other similar fastener mounted to a wall into support aperture 206 such that the downwardly facing surface of plate 202 located directly above support aperture 206 rests atop the fastener, thereby suspending the assembled card game 100 on the vertical surface. In some embodiments of the present invention such as the embodiment depicted in FIG. 2, support aperture 206 is circular with slit 208 extending vertically from its upper edge. Slit 208 further secures an assembled card game 100 to a wall or other vertical surface by allowing the head of a fastener to be inserted through the support aperture 206 until it completely passes therethrough, and thereafter sliding the shaft of the fastener into slit 208. Such a position causes the head of the fastener to act as a stop because its size does not allow it to pass through slit 208. That is, a support aperture 206 having a slit 208 provides further support for an assembled card game 100 when the width of the head of the employed fastener is greater than the width of slit 208 but smaller than the width of support aperture 206. This relationship is such that when the shaft of the fastener is inserted into slit 208, it may only be removed by sliding plate 202, and its assembled cards, upwardly until the shaft of the fastener is removed from slit 208 and is contained within support aperture 206 such that the head of the fastener may pass therethrough, thereby removing the plate from the fastener.

Figure 3:
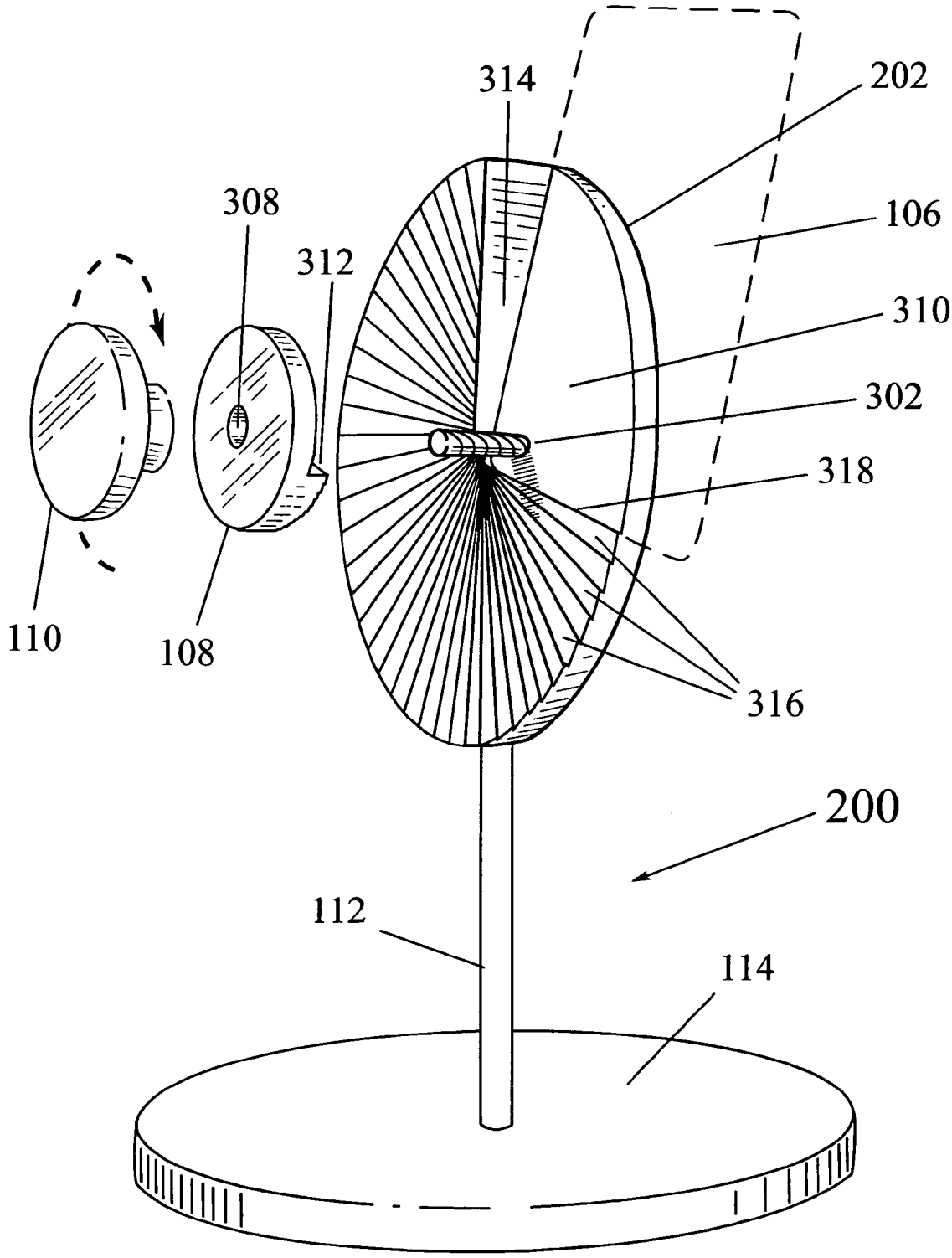
FIG. 3 depicts an angled, front view of the plate, shaft, and base card of the card game illustrated in FIG. 1 with the cards removed in accordance with one embodiment of the present invention including, inter alia, an exploded view of a stop and knob.

Referring now to FIG. 3, illustrated is an angled front view of plate 202 coupled to stand 200, as well as an exploded view of stop 108 and knob 110. As depicted in FIG. 3, plate 202 includes, inter alia, base card plate recess 310, plate wall 314, and intermediate card plate recesses 316. The configuration of plate 202 and its interrelation with stop 108 and knob 110 facilitates stacking and positioning topmost, intermediate, and base cards, 102, 104, and 106, respectively, in a stationary, stacked, circular manner about post 302 such that the faces of such cards create a single coherent image.

To assemble such an image, first, an aperture such as card aperture 502 (FIG. 5) in base card 106 is passed over post 302 until base card 106 is seated in base card plate recess 310. Base card plate recess 310 may have a greater depth than other intermediate plate recesses 316 as it holds base card 106 which is the foundational card for all other cards (i.e., topmost card 102 and intermediate cards 104). In the embodiment of the present invention depicted in FIG. 3, the base card plate recess 310 is located adjacent to and to the right side of plate wall 314, which bisects the upper semicircular half of plate 202. Base card plate recess 310 supports base card 106 such that all corners except the lower left corner of base card 106 extend beyond the perimeter of plate 202. In addition, the bottom edge of base card 106 rests upon lip 318 of base card plate recess 310 such that base card 106 is maintained at the proper angle with respect to post 302. Lip 318 of base card plate recess 310 is a straight edge that radiates approximately from the center of plate 202 to the perimeter of plate 202.

Each intermediate card plate recess 316 is progressively more shallow than base card plate recess 310 such that they form a series of steps beginning at lip 318 of base card plate recess 310 and ending at plate wall 314, thereby ascending in a clockwise direction about post 302. In some embodiments, the depth of each intermediate card plate recess 316 located to the clockwise direction of a previous intermediate or base card plate recess 316 or 310, respectively, is less than the previous plate recess and the difference between the depths of each intermediate card plate recess 316 versus the depth of the previous intermediate card plate recess 316 is an equivalent value. Similar to base card plate recess 310, each intermediate card plate recess 316 forms a lip (i.e., a straight edge that radiates from the approximate center of plate 202 to the perimeter of plate 202) upon which the respective intermediate card 104 rests such that it is maintained at the proper angle with respect to post 302. Maintaining the base and intermediate cards 106 and 104, respectively, at the proper angles with respect to post 302 increases the likelihood that the totality of the faces of such cards will create the desired single coherent image after all cards have been placed in the proper position.

However, virtually any variation of recesses and/or supports may be substituted without departing from the scope of the present invention. For example, embodiments are envisioned in which all or some of the base, intermediate, and top cards do not have a corresponding recess. In some such embodiments, supports may not be provided for such cards or a non-recess support (e.g., a stop) may be substituted.

After placement of base card 106 in base card plate recess 310, an aperture of an intermediate card 104 is passed over post 302 until the respective intermediate card 104 is positioned within the intermediate card plate recess 316 that is adjacent to and to the clockwise direction of base card plate recess 310 such that the bottom edge of intermediate card 104 rests upon the lip of the respective intermediate card plate recess 316. This method continues until all available intermediate card plate recesses 316 are filled in a clockwise manner with the proper intermediate card 104. When the last intermediate card plate recess 316 is filled, the remaining intermediate cards 104 are passed over the post 302 in the correct order and are thereafter supported by a device such as stop 108. Correctly selecting the proper intermediate card 104 to fill each intermediate card plate recess 316 creates the puzzle aspect of the present invention since the final coherent image will not be achieved unless each of the topmost, intermediate, and base cards 102, 104, and 106, respectively, is in the proper position.

After all intermediate card plate recesses 316 have been filled, the card apertures of the remaining intermediate cards 104 are passed over post 302 one by one until all such cards are arranged in a circular fashion with respect to post 302. Thereafter, the card aperture in topmost card 102 is passed over post 302 and positioned such that the totality of the faces of all such cards displays a single coherent image.

Figure 4:
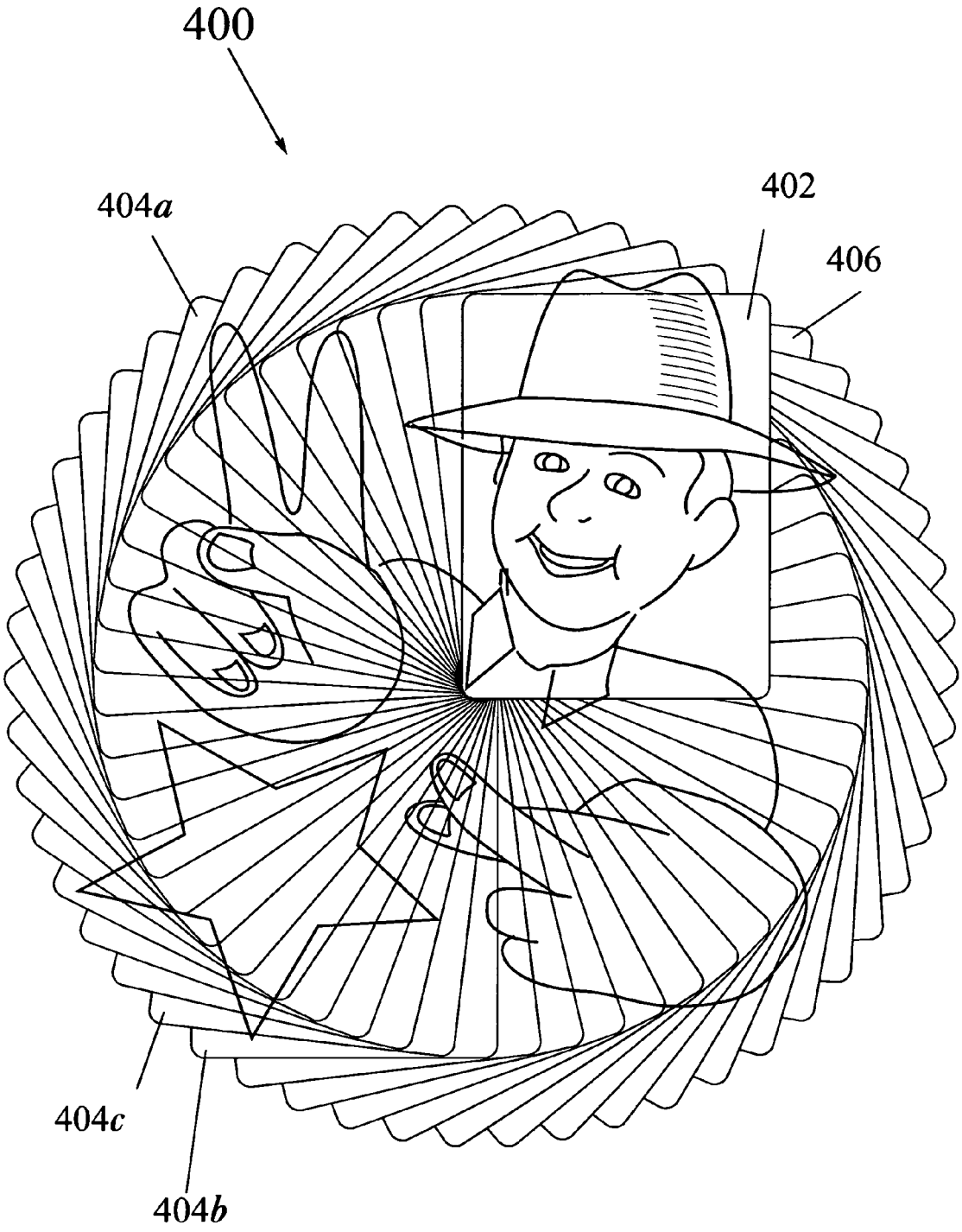
FIG. 4 depicts an assembled coherent image in accordance with one embodiment of the present invention including topmost, intermediate, and base cards.

After topmost, intermediate, and base cards, 102,104, and 106, respectively, have been properly stacked and positioned to create a single coherent image, they may be secured to plate 202 via knob 110, stop 108, and post 302. Stop 108 includes stop aperture 308 and one or more stop lips 312. Stop aperture 308 allows stop 108 to be removably attached to plate 202 by passing stop aperture 308 over post 302. For example, after the card apertures of all topmost, intermediate, and base cards, 102, 104, and 106, respectively, have been passed over post 302 and such cards have been properly positioned to create a single coherent image, stop aperture 308 of stop 108 is passed over post 302 and positioned such that one or more of stop lips 312 supports side edges of intermediate and topmost cards 104 and 102, respectively. Such stop lips 312 have the identical function of the lips of base and intermediate plate recesses 310 and 316, respectively. Similar to the aforementioned recesses, stop lips 312 may be stepped and may radiate to equally spaced points around the perimeter of stop 108. Additionally, the spacing and quantity of stop lips 312 may be designed such that the totality of the faces of topmost, intermediate, and base cards 102, 104, and 106, respectively, may be arranged to form a single coherent image such as image 400 (FIG. 4). Although embodiments of the present invention are envisioned in which every card of topmost, intermediate, and base cards 102, 104, and 106, respectively, is supported by a recess or stop lip such as the embodiment depicted in FIGS. 1-3, many embodiments of the present invention do not have such a configuration.

Finally, after stop 108 has been properly positioned, knob 110 may be threaded onto post 302 until knob 110 firmly affixes topmost, intermediate, and base cards 102, 104, and 106, respectively, to plate 202 such that the image created by the totality of the faces of such cards is preserved as a single, stationary coherent image. In one embodiment of the present invention, knob 110 includes a threaded aperture that is the female counterpart to a threaded post 302, which protrudes from plate 202. After passing stop 108 over post 302, knob 110 may be threaded to post 302 such that stop 108 and topmost, intermediate, and base cards, 102, 104, and 106, respectively, are secured to plate 202. When knob 110 is fully tightened, stop 108 is flush with knob 110 and topmost and intermediate cards 102 and 104, respectively, rendering topmost, intermediate, and base cards 102, 104, and 106, respectively, immovable. Plate 202 may then be hung on a vertical surface as discussed above with respect to FIG. 2, may be attached to shaft 112 and base 114 for resting on a horizontal surface, or may be otherwise displayed with a greatly minimized possibility of a shift in the position of topmost, intermediate, or base cards 102, 104, and 106, respectively (i.e., a distortion of the single coherent image).

In some embodiments of the present invention, one or more of stop 108 and knob 110 may be manufactured from a rigid transparent material that securely affixes topmost, intermediate, and base cards 102, 104, and 106, respectively, to plate 202 while minimizing any blockage of the single coherent image produced by card game 100. Or, alternatively, stop 108 or knob 110 may be manufactured from a slightly resilient material that acts to more securely anchor topmost, intermediate, and base cards 102, 104, and 106, respectively, in their proper position. Or, plate 202 may be manufactured from a slightly resilient material to allow the tightened stop and knob to more tightly secure topmost, intermediate, and base cards 102,104, and 106, respectively.

The quantity of intermediate card plate recesses included in a plate may vary with the quantity of cards included with a specific card game. For example, a plate may include a quantity of base and intermediate card plate recesses that allows each intermediate and base card to be supported by a dedicated intermediate or base plate recess. In addition, a topmost card plate recess may be provided to hold and position topmost card. Alternatively, one or more of topmost and intermediate cards may be solely or additionally supported by stop lips. Or, in yet another embodiment, base or intermediate plate recesses, respectively, may be configured to support the base card or more than one intermediate card, respectively. Any combination of configurations for supporting topmost, intermediate, and base cards may be implemented without departing from the scope of the present invention.

Furthermore, although FIGS. 1-3 depict an attachment mechanism such as stop 108 and knob 110, alternate attachment mechanisms may be substituted without departing from the scope of the present invention. For example, post 302 may alternatively have a permanently attached cap at its longitudinal end opposite the affixed plate that is shaped as the head of a nail, and card apertures 502 may be configured as slots rather than circular apertures. Such slot-shaped apertures would slide over the shaft of post 302 and would be prevented from sliding off post 302 via attachment of the cap.

Referring next to FIG. 4, illustrated is an array of topmost, intermediate, and base cards, 402, 404*a*-404*c*, and 406, respectively, assembled such that a single coherent image 400 is created in accordance with one embodiment of the present invention. Topmost, intermediate, and base cards, 402, 404*a*-404*c*, and 406, respectively, have a shape and configuration similar to the topmost, intermediate, and base cards, 102, 104, and 106, respectively, discussed above with respect to FIGS. 1-3. Image 400 is created by arranging the individual images or portions of images that appear on the faces of topmost, intermediate, and base cards, 402, 404*a*-404*c*, and 406, respectively, until the images on the faces of each of such cards meshes with the images on the faces of all adjacent cards in a seamless side-by-side fashion, thereby creating a single, coherent image 400.

Figure 5:
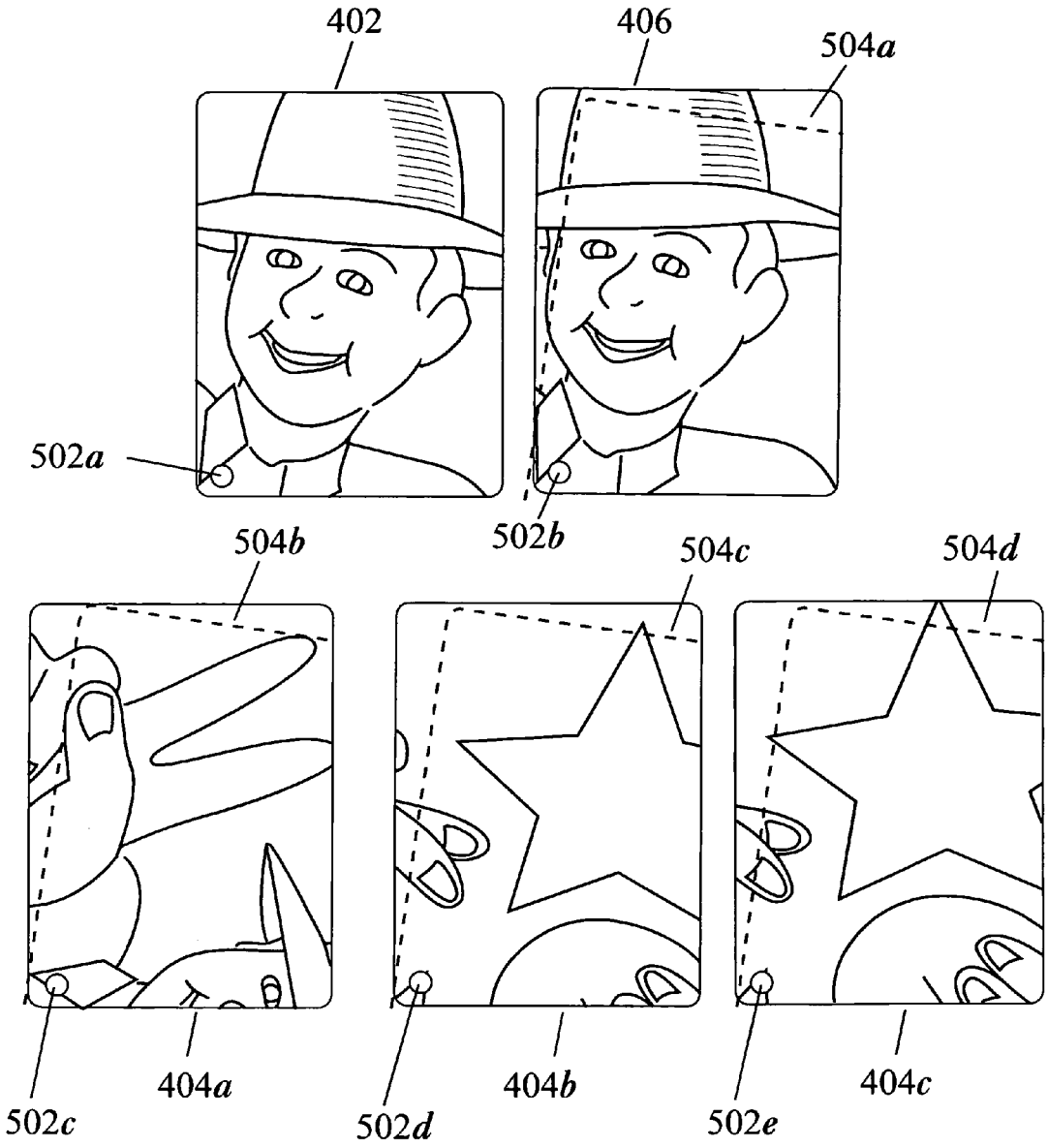
FIG. 5 depicts the faces of a fully-figured topmost card, a fully-figured base card, and three fully-figured intermediate cards in accordance with one embodiment of the present invention including an aperture in each card and dashed lines indicating the obscured portions of each of the base and intermediate cards.
Figure 6:
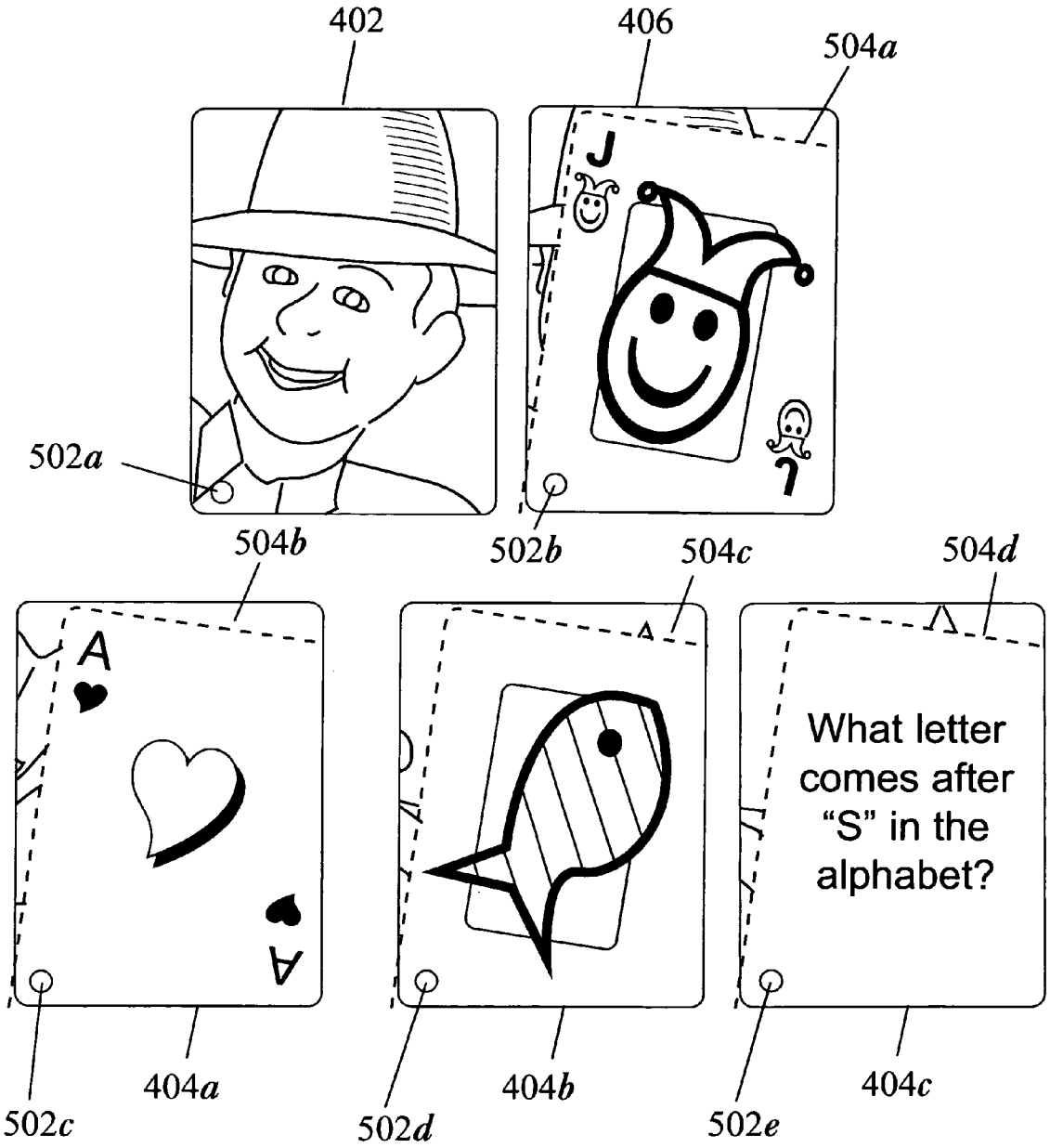
FIG. 6 depicts the faces of a fully-figured topmost card, a partially-figured base card, and three partially-figured intermediate cards in accordance with one embodiment of the present invention including an aperture in each card and dashed lines indicating the obscured portions of each of the base and intermediate cards.

The faces of each of topmost, intermediate, and base cards 402, 404*a*-404*c*, and 406, respectively, may include a varying amount of visual information. For example, such faces may be fully-figured or partially-figured as illustrated in FIGS. 5 and 6, respectively. Each of the cards depicted in FIGS. 5 and 6 is depicted as it would appear prior to assembly or after removal from plate 202.

Each of the cards depicted in FIGS. 5 and 6 includes one of card apertures 502*a*-502*e* to facilitate assembly of image 400 and attachment of such image to plate 202 as discussed in greater detail above with respect to FIG. 3. In this embodiment of the present invention, card apertures 502 are located at the same position on each of topmost, intermediate, and base cards 402, 404, and 406, respectively, to cause each card to be anchored to plate 202 at the same point. The use of an identical anchor point and identical locations of card apertures 502 facilitates creation of the circular configuration of the resulting image 400.

Referring now to FIG. 5, depicted are topmost, intermediate, and base cards 402, 404*a*-404*c*, and 406, respectively, having fully-figured faces. Dashed lines 504*a*-504*d* delineate the portions of base and intermediate cards, 406 and 404*a*-404*c*, respectively, that are visible in image 400 when a card game such as card game 100 is fully assembled. That is, when a card game of the present invention is fully assembled, the portion of the face of each card located above and to the left of dashed lines 504*a*-504*d* comprises a portion of image 400 and the portion of the face of each card located below and to the right of dashed lines 504*a*-504*d* is hidden behind adjacent, overlapping topmost or intermediate cards 402 and 406, respectively.

Turning next to FIG. 6, depicted are topmost, intermediate, and base cards 402, 404*a*-404*c*, and 406, respectively, having partially-figured faces. Similar to the cards depicted in FIG. 5, dashed lines 504*a*-504*d* delineate the portions of base and intermediate cards, 406 and 404*a*-404*c*, respectively, that are visible in image 400 when a card game such as card game 100 is fully assembled. That is, when a card game of the present invention is fully assembled, the portion of the faces of the cards located above and to the left of dashed lines 504*a*-504*d* comprises a portion of image 400 and the portion of the faces of the cards located below and to the right of dashed lines 504*a*-504*d* is hidden behind adjacent, overlapping topmost or intermediate cards 402 and 406, respectively. Since each base and intermediate card, 406 and 404, respectively, includes a relatively small portion of image 400, it is likely that adjacent cards of the assembled card game 100 will closely resemble each other, thereby increasing the complexity of assembling the card game of the present invention.

In contrast to the fully-figured card faces depicted in FIG. 5, the partially-figured card faces in FIG. 6 may optionally contain information or images that are not related to image 400, which may appear below and to the right of dashed lines 504*a*-504*d*. For example, each of these portions of the faces of base and intermediate cards, 406 and 404, respectively, may include a face one card of a standard deck of playing cards. In this scenario, since the face of topmost card 402 is completely covered with a figure, it will serve as one of the two jokers of a standard deck of cards. Also, in this example, the face of a second joker is included in the portion of the card face of base card 406 located below and to the right of dashed line 504*a*. In another example of this embodiment, the portion of the face of intermediate card 404*a* located below and to the right of dashed line 504*b* includes the ace of hearts. All other cards of the deck similarly represent one of the required cards in a standard deck of playing cards.

Alternatively, information related to a special deck of cards may be included to the right and below dashed lines 504*a*-504*d*. Specifically, these hidden areas may include letters, numbers, or images that allow for the playing of other card games that are either already in existence, or are yet to be invented. For example, FIG. 6 depicts the hidden portion of intermediate card 404*b* as the face of a Go Fish® card in accordance with one embodiment of the present invention. In this embodiment of the present invention, the hidden portion of each of the faces of base and intermediate cards 406 and 404 would depict a different card of an Old Maid® card deck. In this embodiment, topmost card 402 could be employed as a wild card, since topmost card 402 does not have a hidden area for placement of an additional image. Although the embodiment of the present invention depicted with respect to intermediate card 404*b* is that of a Go Fish® card, cards for alternate games could be included without departing from the scope of the present invention.

Similarly, intermediate card 404*c* of FIG. 6 depicts an embodiment of the present invention that includes an educational flash card. In particular, the portion of the face of intermediate card 404*c* located below and to the right of dashed line 504*d* depicts an alphabetical question. However, other types of educational questions (e.g., multiplication tables, history questions, etc.) may be substituted without departing from the scope of the present invention. In such embodiments of the present invention, base card 406 and all intermediate cards 404 may include a different educational question related to or unrelated to the image that results from assembly of the respective card game. In this embodiment, fully-figured topmost card 402 may not serve an educational purpose since topmost card 402 does not have a hidden area for placement of an educational question or image. However, such fully-figured cards may serve another purpose (e.g., may provide a free point when drawn). Although the educational embodiment depicted with respect to intermediate card 404*c* contains an educational question intended for a young child, questions for other ages (e.g., teenagers, adults, etc.) or non-educational questions (e.g., trivia) could be substituted without departing from the scope of the present invention.

Although, FIG. 6 depicts various specific embodiments of the hidden areas of intermediate and base cards 404 and 406, respectively, other embodiments could be included without departing from the scope of the present invention. Any images or other content could be included in the hidden portion of these cards as long as it is contained within the hidden portion and does not thereby change the appearance of image 400.

Referring now to both FIGS. 5 and 6, topmost card 402 does not include a dashed line since the entire face of topmost card 402 is visible in image 400. Furthermore, in the embodiments of the present invention including cards as depicted in FIG. 5, topmost card 402 bisects the upper semicircular half of image 400 and includes the most significant portion of the coherent image, which in this embodiment depicts a man's head, to provide a more satisfying sense of completion to image 400. Although the image 400 depicted in FIG. 4, depicts a topmost card 402 that bisects the upper semicircular half of image 400, other embodiments of the present invention are envisioned in which topmost card 402 is located in an alternate location without departing from the spirit of the present invention.

Furthermore, as discussed in greater detail below with respect to FIG. 18, the backs of topmost, intermediate, and base cards 402, 404*a*-404*c*, and 406, respectively, may each include one card of a standard deck of cards or one card of a special deck of cards as discussed above with respect to FIG. 1. Alternatively, the backs of each card could contain a portion of a second image similar to image 400 to allow one set of cards to be assembled to create either of two, distinct images. In yet another embodiment, the backs of topmost, intermediate, and base cards 402, 404*a*-404*c*, and 406, respectively, may include information that is either related to or unrelated to image 400, and is included to increase the enjoyment, educational value, or utility of the card game (e.g., such information may create flash cards that allow children to study various subjects).

Figure 7:
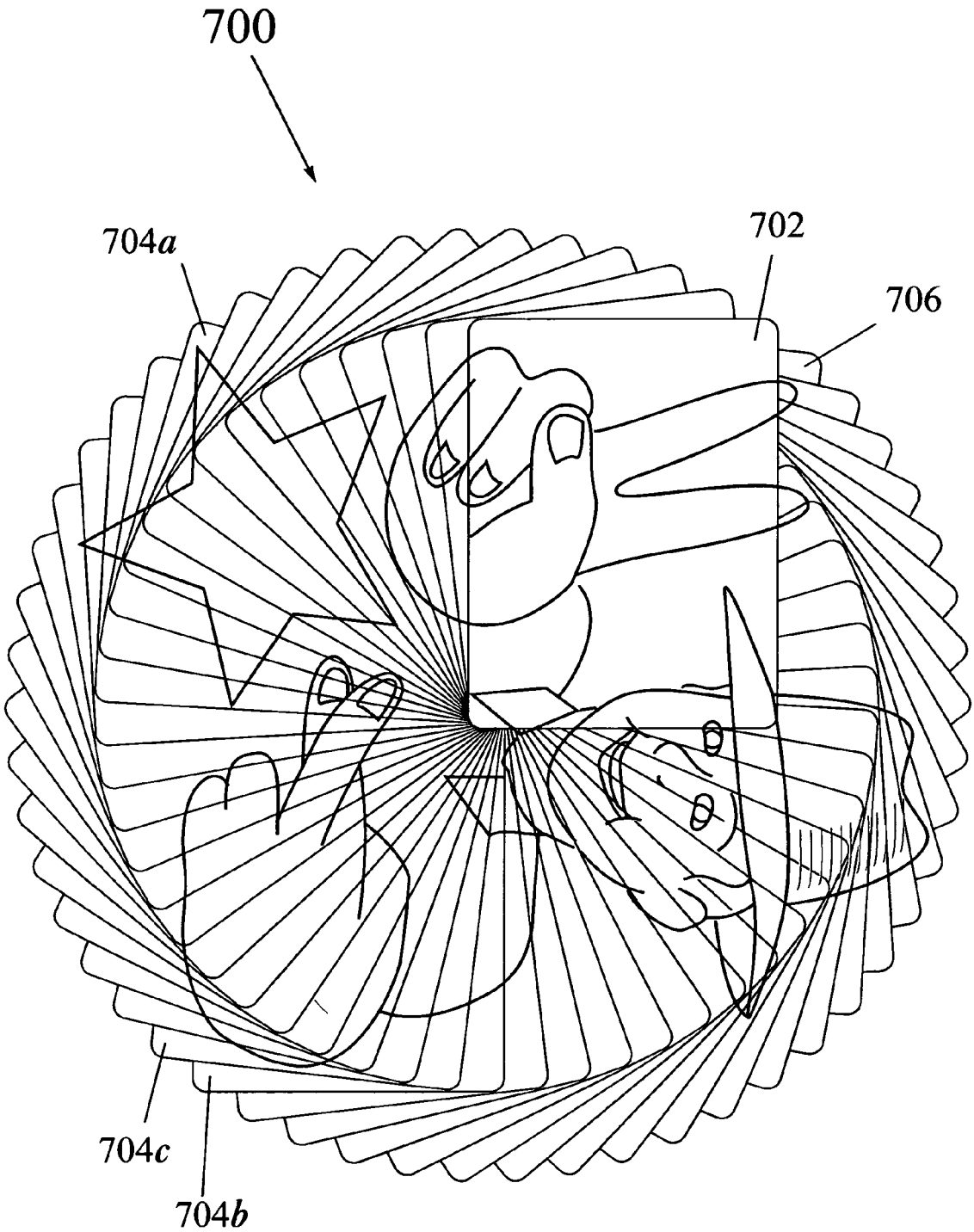
FIG. 7 depicts an assembled coherent image in accordance with the embodiment of the present invention depicted in FIG. 4 including topmost, intermediate, and base cards in which a different card has been selected as the base card causing the image to rotate clockwise ninety degrees.

Turning next to FIG. 7, illustrated is an alternate array of the topmost, intermediate, and base cards 402, 404, and 406, respectively, depicted in FIGS. 4 and 5. In this array of such cards, a different coherent image results due to the selection of a different base card 706 as compared to base card 406 selected for the coherent image depicted in FIG. 4. This selection of base card 706 causes the resulting image 700 to be rotated clockwise with respect to the resulting image 400 that is created when base card 406 is selected as depicted in FIG. 4, despite the fact that an identical deck of cards is employed. Such clockwise rotation occurs since selection of a different base card 706 alters the card that is finally placed as topmost card 702. Since base card 706 is the first card to be placed atop plate 202, changing the card incorporated for base card 706 automatically causes resulting image 700 to be oriented at an angle different than image 400 although topmost card 702 is located in the same position as topmost card 402.

The ability to change the orientation of the resulting single coherent image is best accommodated using a deck of cards comprised completely of fully-figured topmost, intermediate, and base cards 702, 704, and 706, respectively. Use of such cards allows a quantity of rotated resulting images equal to the quantity of cards contained in the specific deck of cards (i.e., any one of the cards may be selected as base card 706 allowing any one of the cards to become topmost card 702). For example, the change in the base card from base card 406 as depicted in FIG. 4 to base card 706 as depicted in FIG. 7 changes the image represented on the face of the topmost card from the head of a man as depicted in FIG. 4 to the right hand of the man as depicted in FIG. 7.

Figure 8:
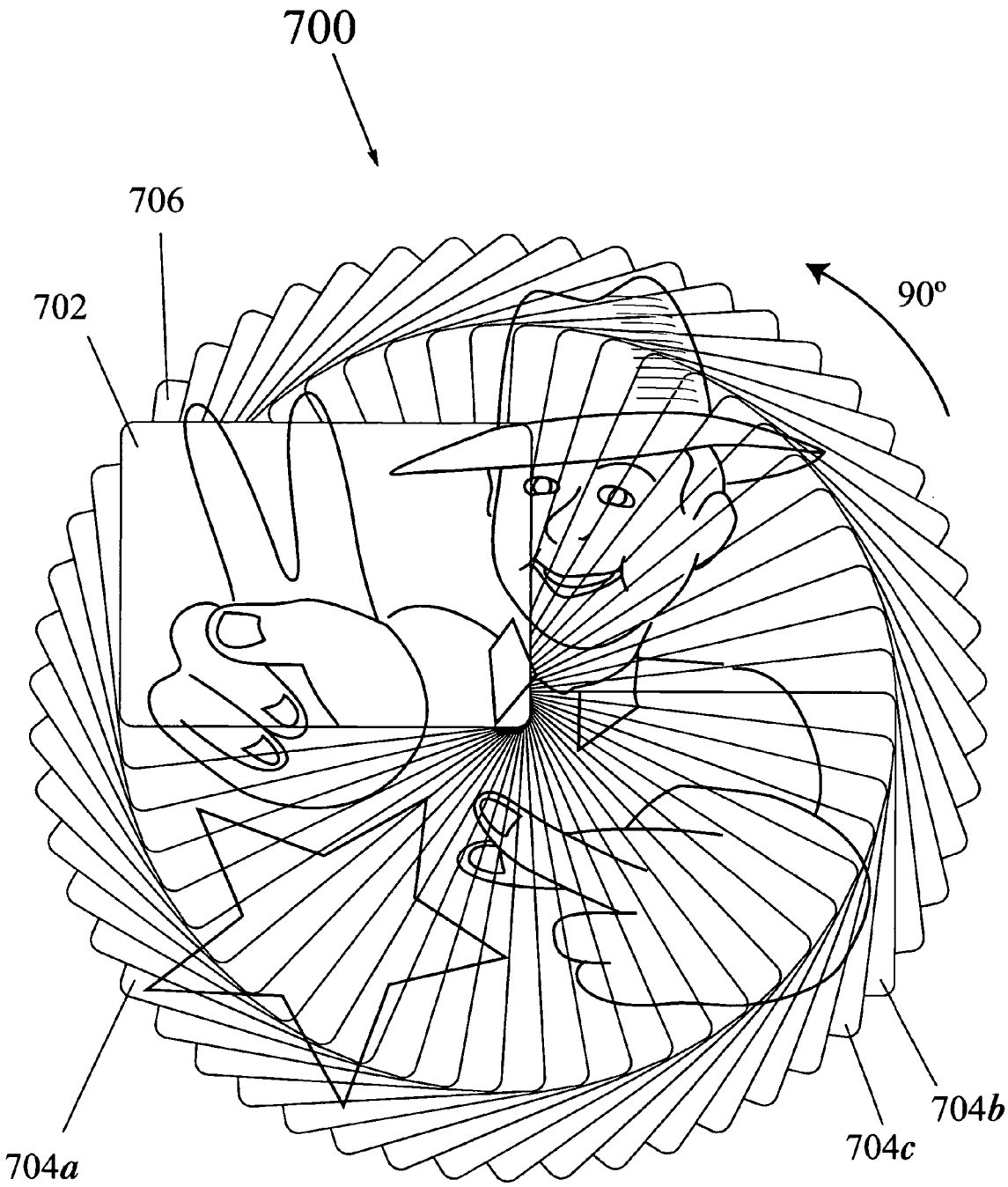
FIG. 8 depicts an assembled coherent image in accordance with the embodiment of the present invention depicted in FIG. 7 in which the image has been rotated counterclockwise ninety degrees to provide a more aesthetically pleasing display.

Depicted in FIG. 8 is image 700 as depicted in FIG. 7 rotated ninety degrees counterclockwise to allow image 700 to be displayed in a more aesthetically pleasing position (i.e., in a position in which the image of the man is upright). The degrees and direction of rotation required to display any final assembled image in an aesthetically pleasing position depends directly on the card that has been selected to be base card 706 and the type of image being displayed. For example, some abstract images may require no rotation whatsoever in order to be aesthetically pleasing as a finished image regardless of which card is selected to be base card 706.

In order to accommodate all of the possible degrees and directions of rotation that may be required for a final assembled coherent image in an embodiment of the present invention wherein any card may be selected at random to be base card 706, an alternate embodiment of plate 202, plate 1302 (FIG. 13), or stand 1408 (FIG. 14) may be incorporated that allows the assembled array of topmost, intermediate, and base cards 702, 704, and 706, respectively, to be rotated 3600 while attached to stand 200 (FIG. 2). Alternatively, stand 200 may be configured such that it may be positioned at any angle of rotation atop a horizontal surface or may be hung at any angle of rotation on a vertical surface (e.g., multiple support apertures may be positioned in a circular pattern through the rear of plate 202).

Figure 9:
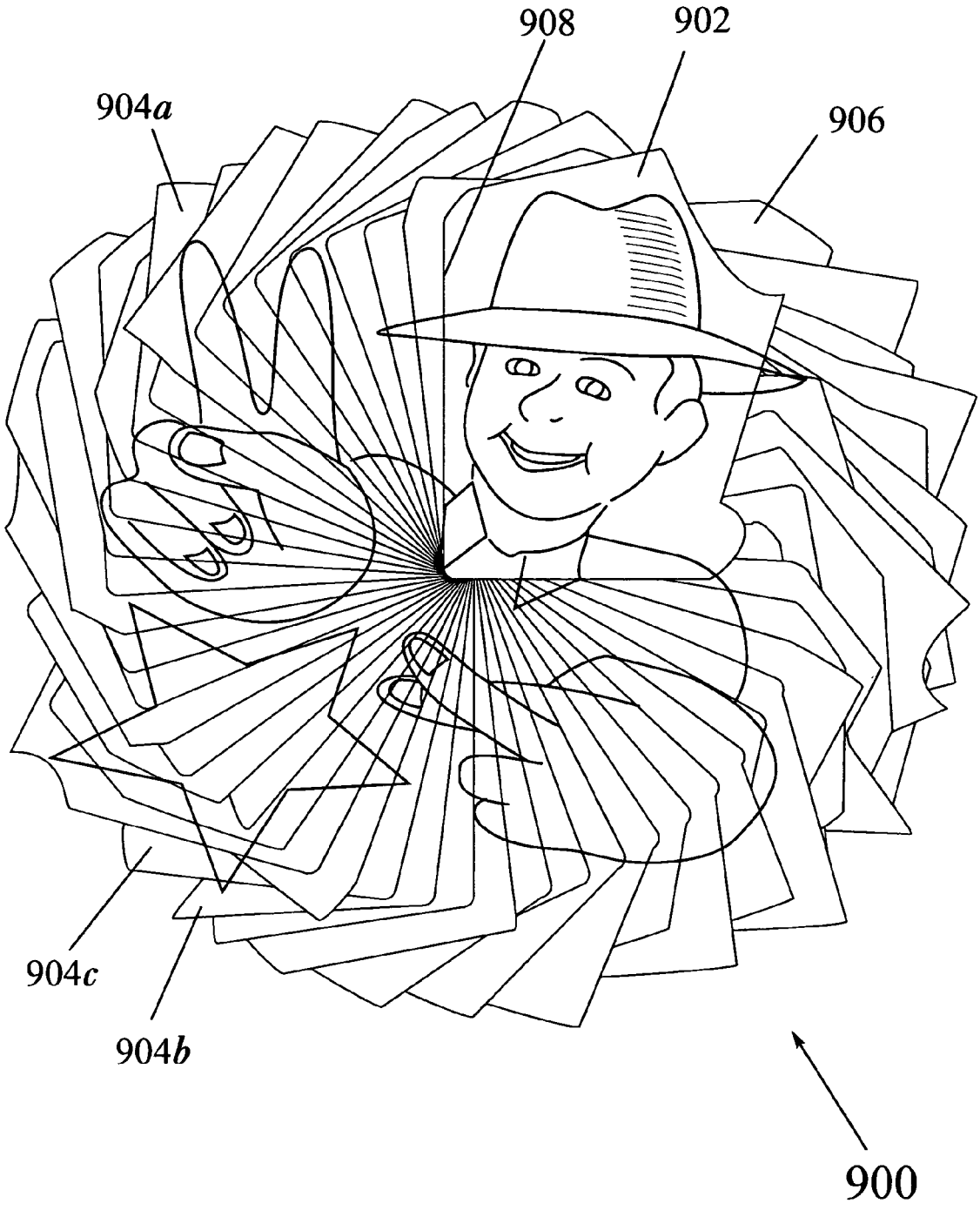
FIG. 9 depicts an assembled coherent image in accordance with one embodiment of the present invention including topmost, intermediate, and base card in which each of the cards has a varying shape and size.

Turning now to FIG. 9, depicted is image 900 in accordance with an alternate embodiment of the present invention in which each card has a varied shape and size. Image 900 is created by a circular configuration of topmost, intermediate, and base cards 902, 904, and 906, respectively, similar to the circular configuration of cards in card game 100 as described above with respect to FIGS. 1-8. However, whereas the embodiments of the present invention depicted in these figures have equal rectangular shapes, the embodiment of the present invention depicted in FIG. 9 includes topmost, intermediate, and base cards 902, 904, and 906, respectively, having varied shapes and sizes.

To accommodate cards having such varied shapes, some embodiments of the present invention include cards having one or more standardized edges 908. For example, the embodiment depicted in FIG. 9 includes cards having a standardized left edge. Standardized edges 908 allow a player of the card game to perform a systematic side-by-side comparison of the cards to determine the order in which such cards should be stacked and/or arranged in a circular manner. Without such a standardized edge, the complexity of the card game is greatly increased. By varying the shapes and sizes of such cards, resulting images having a variety of shapes may be created. For example, each card may be shaped such that the final resulting image is in the shape of an animal, a star, a four-leaf clover, a heart, etc. to allow the card game to be tailored for specific events, holidays, etc.

Figure 10:
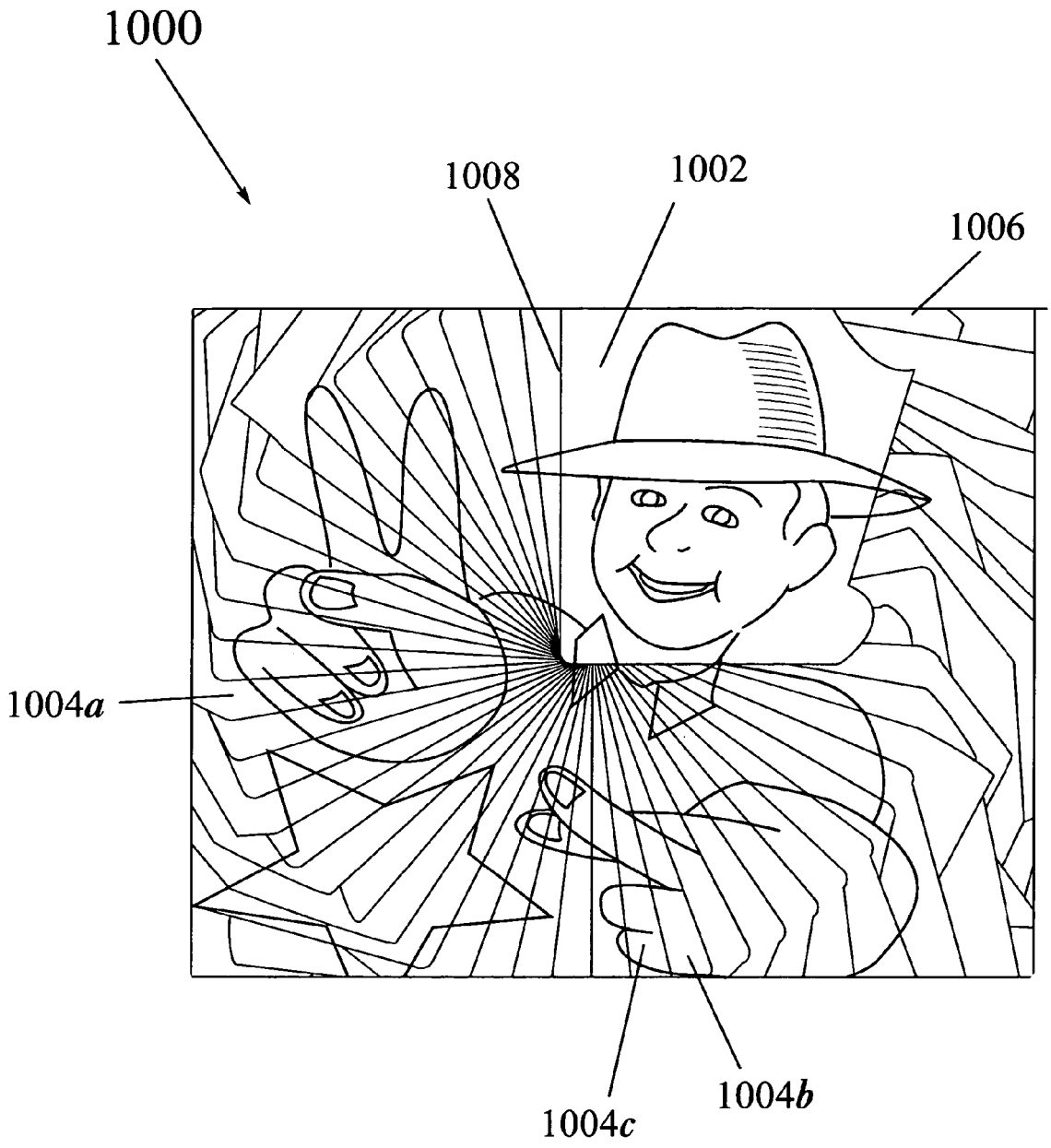
FIG. 10 depicts an assembled coherent image in accordance with one embodiment of the present invention including topmost, intermediate, and base cards in which the cards are assembled such that the resulting coherent image is rectangular.

Furthermore, as depicted in FIG. 10, the shape of topmost, intermediate, and base cards 1002, 1004, and 1006, respectively, may be configured such that the resulting image 1000 is rectangular in shape. Additionally, this rectangular shape may allow image 1000 to be framed using a standard, rather than custom, frame. Similar to the embodiment depicted in FIG. 9, each of topmost, intermediate, and base cards 1002, 1004, and 1006, respectively, includes standardized edge 1008 to facilitate assembly of the card game by allowing the player to perform a systematic side-by-side comparison of the aforementioned cards.

Figure 11A:
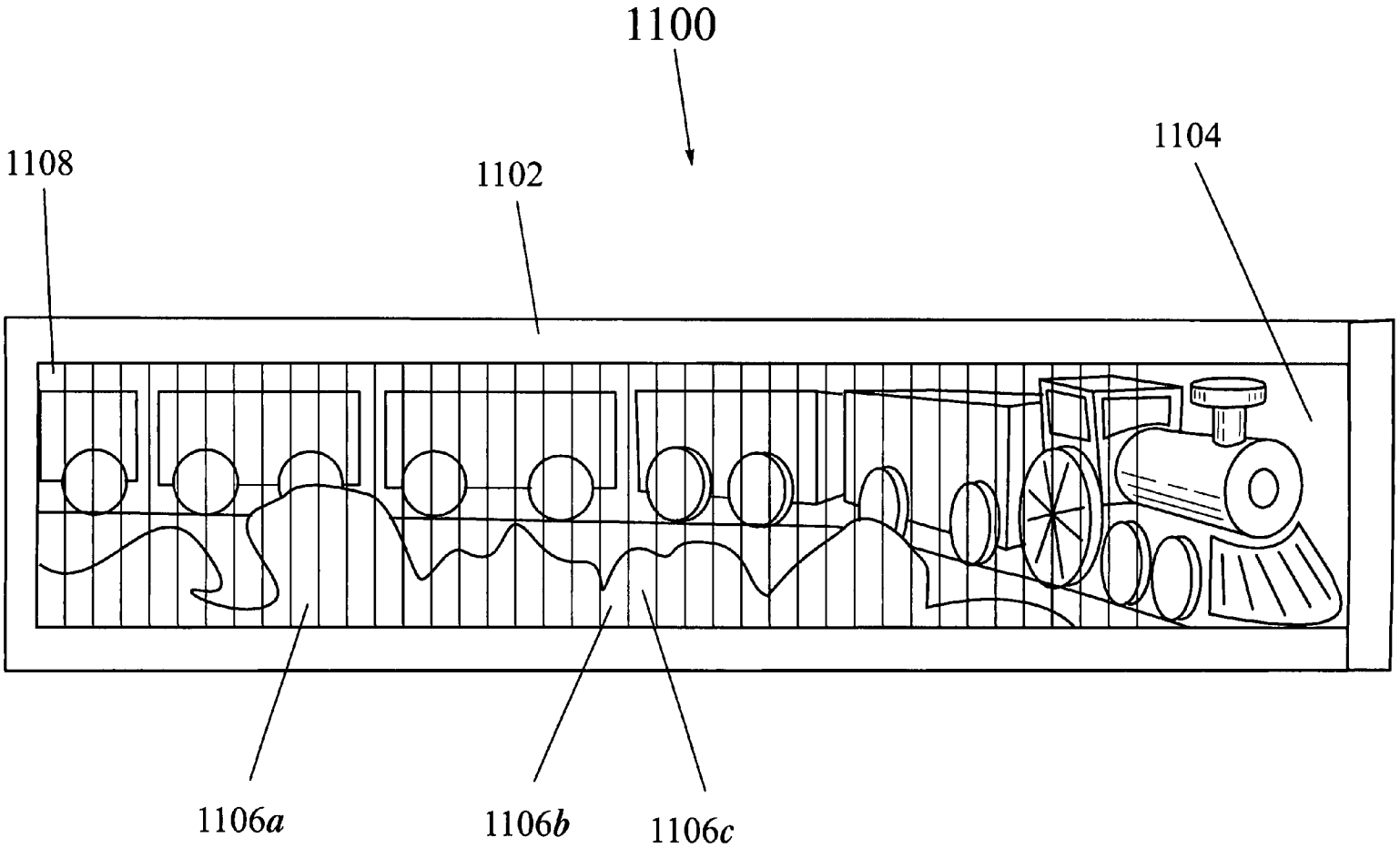
FIG. 11A depicts a front view of an assembled linear card game in accordance with one embodiment of the present invention including, inter alia, cards and rectangular plate.

Referring next to FIG. 11A, depicted is an assembled linear card game 1100 in accordance with an embodiment of the present invention. In this embodiment, stand 1102 may be employed to arrange each of the topmost, intermediate, and base cards 1104, 1106, and 1108, respectively, in a linear fashion. In card game 1100, intermediate and base cards 1106, and 1108, respectively may be fully-figured or partially-figured. In the latter embodiment, a segment of the final coherent image is located on the left side of the card face. As discussed herein, the portion of the faces of intermediate and base cards 1106 and 1108, respectively, that does not include a segment of the final coherent image may be blank or printed with other images, numbers, graphics, or the like.

Figure 11B:
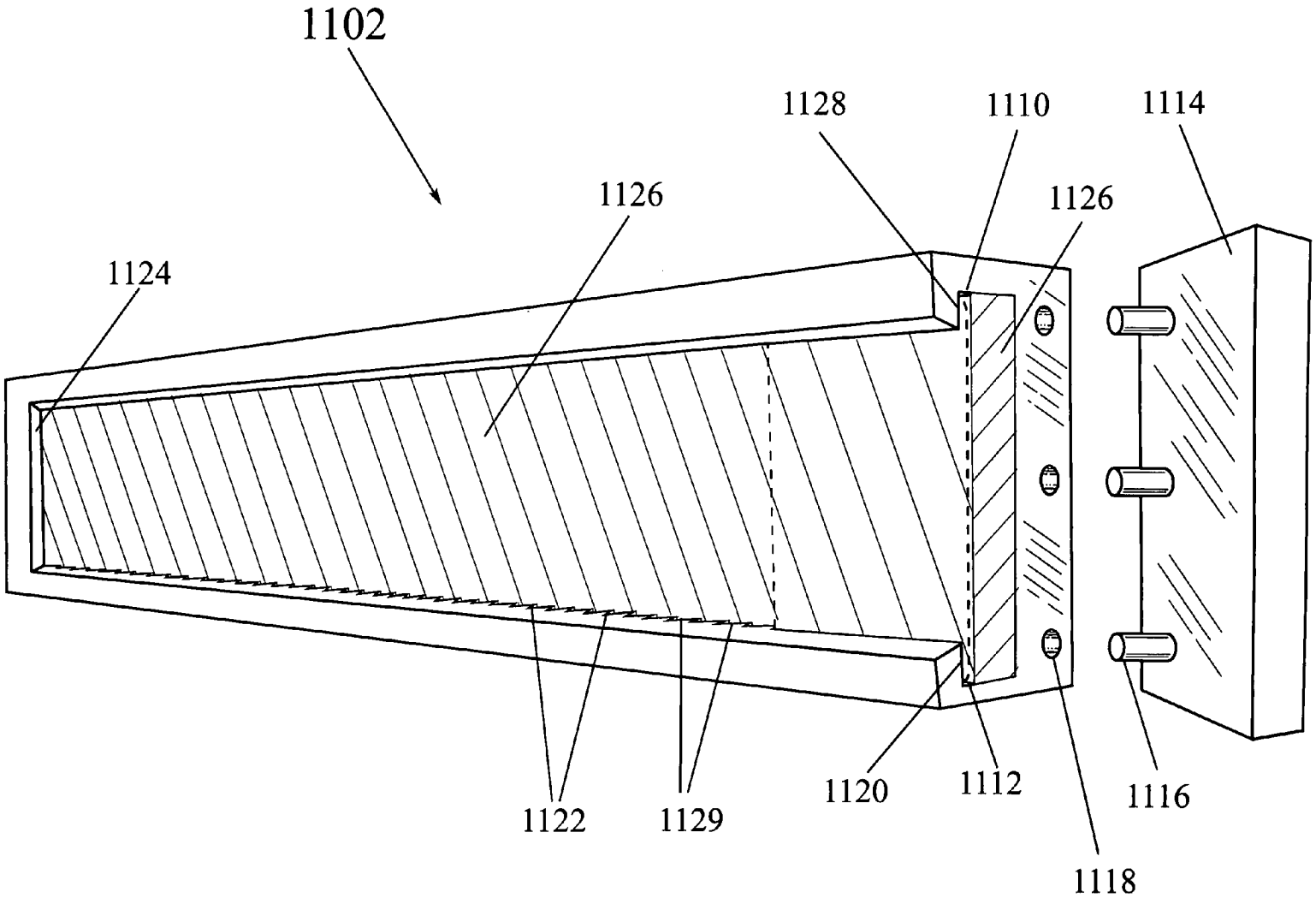
FIG. 11B depicts an angled, front view of the stand of the card game illustrated in FIG. 11A with the cards and cap removed in accordance with one embodiment of the present invention.

Turning next to FIG. 11B, depicted is an angled front view of stand 1102 with cap 1114 removed, which may be used in conjunction with a deck of cards to create an assembled linear card game 1100 (FIG. 11A). First, a player removes cap 1114. In the embodiment of the present invention depicted in FIG. 11B, cap 1114 is affixed to stand 1102 by insertion of pegs 1116 into corresponding peg apertures 1118, however, any method of securing cap 1114 to stand 1102 may be incorporated without departing from the scope of the present invention.

After cap 1114 is removed, topmost, intermediate, and base cards 1104, 1106, and 1108, respectively, may be slid into stand 1102 such that the upper portion of the face of such cards abuts the inwardly facing upper slit wall 1128 of upper slit 1110 and the lower portion of the face of such cards abuts the inwardly facing lower slit wall 1120 of lower slit 1112. Furthermore, lower slit wall 1120 optionally includes recesses 1129 having integral recess lips 1122, which impede the leftward longitudinal motion of cards inserted therein. However, any card may be advanced beyond any recess lip 1122 toward left wall 1124 by applying pressure to the face of the card in the direction of inner wall 1126. Preferably, inner wall 1126 is manufactured from a resilient material such as rubber or synthetic foam that allows motion of a card toward inner wall 1126 when pressure is exerted on the card's face, however, other materials may be substituted without departing from the scope of the present invention. Use of such a material allows inner wall 1126 to remain in an uncompressed state when no pressure is exerted on a card, thereby causing the face of each card to abut lower and upper slit walls 1120 and 1128, respectively. Such material also allows inner wall 1126 to contract when pressure is applied to the card, thereby allowing the card to clear recess lip 1122 such that the card may be slid longitudinally toward left wall 1124. In some embodiments of the present invention, upper slit wall 1128 also includes recesses and recess lips similar to recesses 1129 and recess lips 1122. After insertion of all cards in the deck of cards in the aforementioned manner, stand 1102 supports and secures topmost, intermediate, and base cards 1104,1106, and 1108, respectively, in a manner suitable to the aesthetic display of the coherent image in an upright position.

Figure 11C:
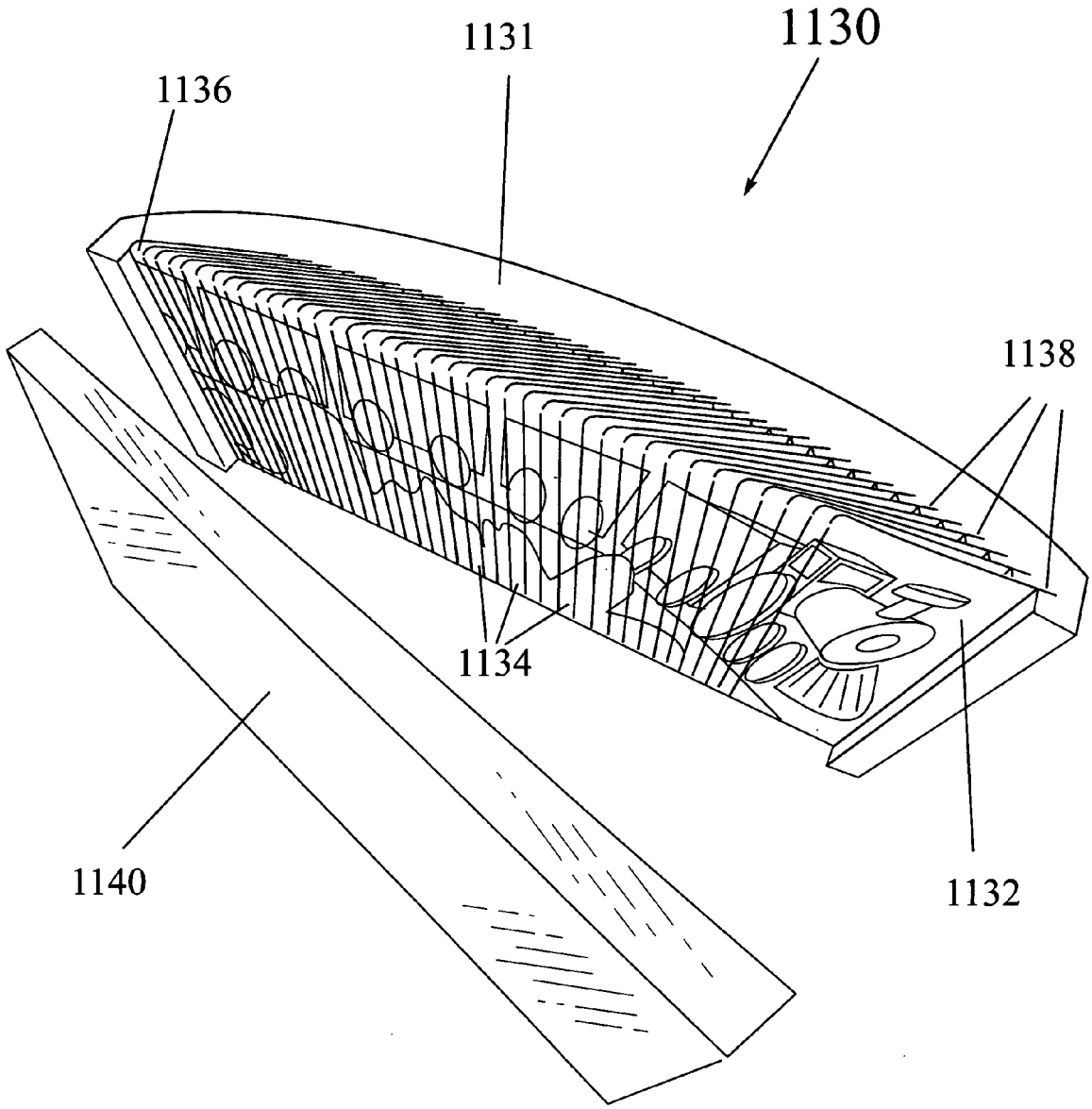
FIG. 11C depicts an angled, top view of an alternate assembled linear card game with the cover removed in accordance with one embodiment of the present invention including, inter alia, cards and stand.

Turning next to FIG. 11C, depicted is an angled top view of another embodiment of an assembled linear card game 1130. Similar to stand 1102, stand 1131 is also designed to hold an assembled deck of topmost, intermediate, and base cards 1132, 1134, and 1136, respectively, in a linear fashion. Cards are anchored within stand 1131 by insertion of such cards into slits 1138, which are individually cut into the inner wall of stand 1131. In some embodiments of the present invention, stand 1131 may include transparent cover 1140, which further secures topmost, intermediate, and base cards 1132, 1134, and 1136, respectively, within stand 1131 by exerting pressure on the faces of such cards. Furthermore, regardless of whether a cover such as cover 1140 is designed to secure cards within a stand, such a cover may be included in some embodiments of the present invention, including circular embodiments, to protect the cards from dust, debris, or the like, or to enhance the display of assembled linear or circular card games.

Figure 11D:
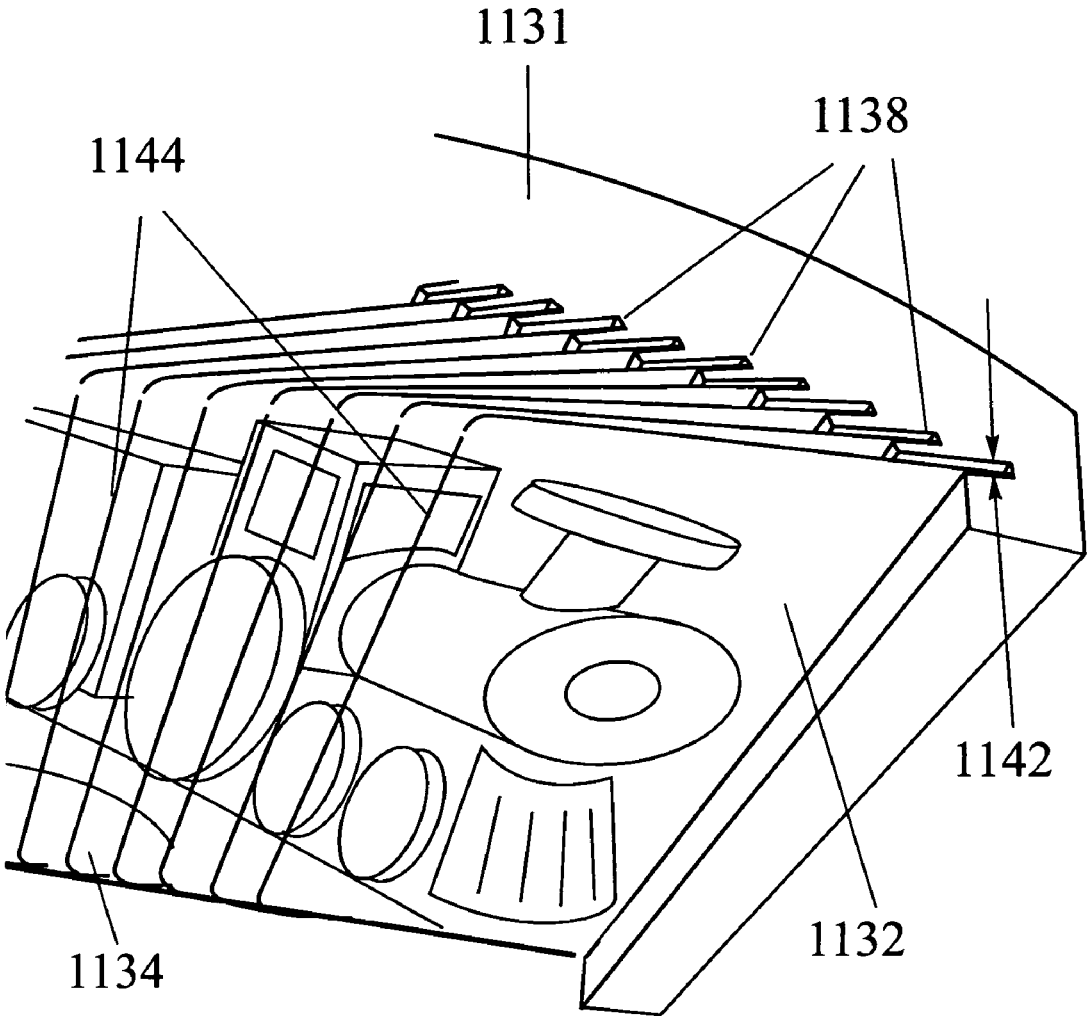
FIG. 11D depicts a magnified, angled, top view of the slits of the card game illustrated in FIG. 11C.

Referring next to FIG. 11D, depicted is a magnified view of slits 1138 of assembled linear card game 1130 as depicted in FIG. 11C. Slits 1138 are configured to firmly hold each of topmost, intermediate, and base cards 1132, 1134, and 1136, respectively, by the compressive stress caused by the constraining width 1142 and the angled cut of slits 1138, and the resilience of the topmost, intermediate, and base cards 1132, 1134, and 1136, respectively. More specifically, the angled cuts that create slits 1138 are designed to vary gradually between adjacent slits 1138 such that left edge 1144 of each card inserted into slit 1138 is in full contact with the face of the card present in an adjacent leftward slit 1138. That is, the angle of each slit 1138 is such that left edge 1144 of each inserted card intersects the plane of the adjacent leftward card, however, the presence of the adjacent leftward card and the resilience of the card material causes the inserted card to bend such that the pressure of the bend maintains the left edge 1144 of the inserted card in full contact with the face of the adjacent leftward card.

In some embodiments of the present invention, the elliptical, oval, or ovate shape of stand 1131 facilitates an intense angling of slits 1138, which helps increase the pressure exerted by each card on the adjacent leftward card. However, such shape is not a required aspect of the present invention. Also, alternate methods of securing cards within plates, stands, or the like whether such configurations are linear, circular, or otherwise, and whether such configurations includes compressive stress, friction, resilient card materials, anchoring methods, or the like may be substituted without departing from the scope of the invention.

As discussed above with respect to alternate embodiments, intermediate and base cards 1106 and 1108, respectively, as well as intermediate and base cards 1134 and 1136, respectively, may be fully-figured or partially-figured, wherein the latter embodiment may include information that is not a subsection of the resulting image in the hidden areas. Similarly, such cards may include standardized left edges such as left edges 1144 to accommodate a systematic side-by-side comparison of all cards, thereby allowing a player of the card game to properly arrange such cards to achieve a single coherent image. Furthermore, stands 1102 and 1131 may be modified as necessary to accommodate display on a vertical or horizontal surface.

Figure 12:
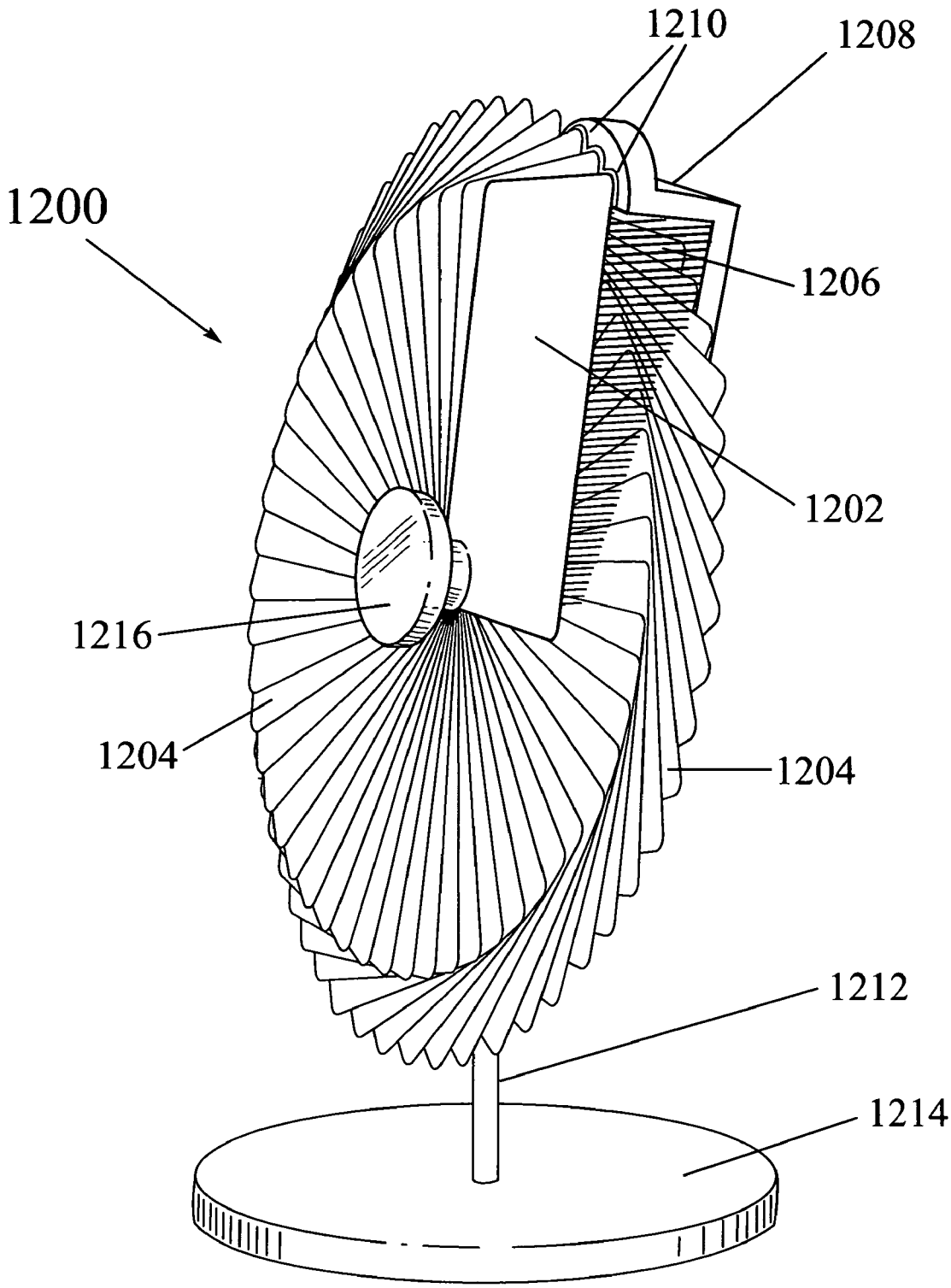
FIG. 12 depicts an angled, front view of an assembled card game in accordance with one embodiment of the present invention including a plate having a plate extension, cards, knob, base, and shaft.

Referring next to FIG. 12, depicted is an alternate embodiment of the present invention substantially equivalent to the embodiment discussed above with respect to FIGS. 1-3. However, the embodiment depicted in FIGS. 12-13 has two anchor points for some cards, in lieu of the one anchor point discussed above with respect to FIG. 5. First, one or more of the topmost, intermediate, and base cards 1202, 1204, and 1206, respectively, are anchored to plate extension 1208 by inserting a corner of such cards into a corresponding extension recess 1210 of plate extension 1208. Such insertion anchors each of these cards at a point opposite the second anchor point (i.e., the card aperture located in the opposite corner of the cards).

After all intended cards have been inserted in the corresponding extension recesses 1210 of plate extension 1208, the topmost, intermediate, and base cards 1202, 1204, and 1206, respectively, are further anchored to plate 1302 (FIG. 13) via a mechanism such as knob 1216, or a knob and stop combination, as discussed in greater detail above with respect to FIG. 3. This anchoring allows the topmost, intermediate, and base cards 1202, 1204, and 1206, respectively, to be fixed in an immovable position such that the arrangement of the entire face of topmost card 1202 and the visible edges of the faces of intermediate and base cards, 1204 and 1206, respectively, can be viewed simultaneously. The totality of the face of topmost card 1202 and the exposed edges of the faces of the intermediate and base cards, 1204 and 1206, respectively, creates one larger coherent image as described in greater detail above with respect to FIGS. 4-11. Furthermore, inclusion of a removably attached shaft 1212 having an integral or removable base 1214 allows the assembled cards to be displayed on a horizontal surface as discussed in greater detail above with respect to FIG. 2.

Figure 13:
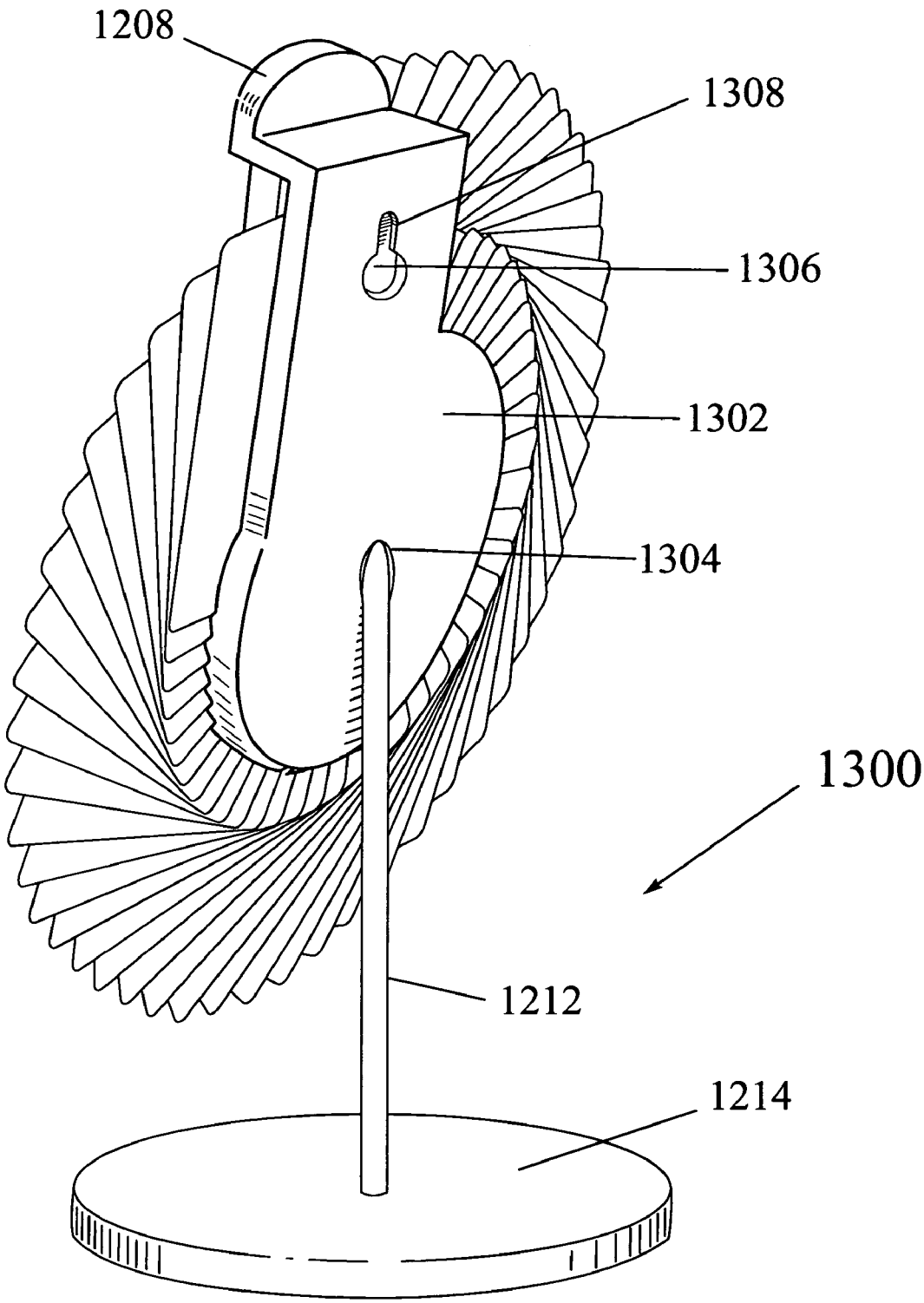
FIG. 13 depicts an angled, rear view of the assembled card game illustrated in FIG. 12 in accordance with one embodiment of the present invention including, inter alia, a plate having a plate extension, plate recesses, a support aperture, and a shaft aperture.

Turning next to FIG. 13, depicted is an angled rear view of an assembled card game 1200 including an angled rear view of stand 1300. In the embodiment of the present invention depicted in FIG. 13, stand 1300 includes shaft 1212 and base 1214. The lowermost end of shaft 1212 may be permanently or removably attached to base 1214, while the uppermost end of shaft 1212 is permanently or removably inserted into and affixed to shaft aperture 1304 included in plate 1302. Inclusion of an aspect of the present invention such as stand 1300 allows an assembled card game such as card game 1200 to rest atop a table, shelf, or other flat surface to facilitate display of card game 1200.

Alternatively, when shaft 1212 is removed from shaft aperture 1304, card game 1200 may be suspended from a wall or other vertical surface by inserting the head of a nail, screw, or other similar fastener mounted to a wall into support aperture 1306 such that the downwardly facing surface of plate 1302 located directly above support aperture 1306 rests atop the fastener, thereby suspending card game 1200 on the vertical surface. In some embodiments of the present invention such as the embodiment depicted in FIG. 12, support aperture 1306 is circular with slit 1308 extending vertically from its upper edge. Slit 1308 further secures card game 1200 to a wall or other vertical surface by allowing the head of a fastener to be inserted through the support aperture 1306 until it completely passes therethrough, and thereafter sliding the shaft of the fastener into slit 1308. Such a position causes the head of the fastener to act as a stop because its size does not allow it to pass through slit 1308. That is, a support aperture 1306 having a slit 1308 provides further support for card game 1200 when the width of the head of the employed fastener is greater than the width of slit 1308 but smaller than the width of support aperture 1306. This relationship is such that when the shaft of the fastener is inserted into slit 1308, it may only be removed by sliding plate 1302, and its assembled cards, upwardly until the shaft of the fastener is removed from slit 1308 and is contained within support aperture 1306 such that the head of the fastener may pass therethrough and release the game from the fastener.

Figure 14:
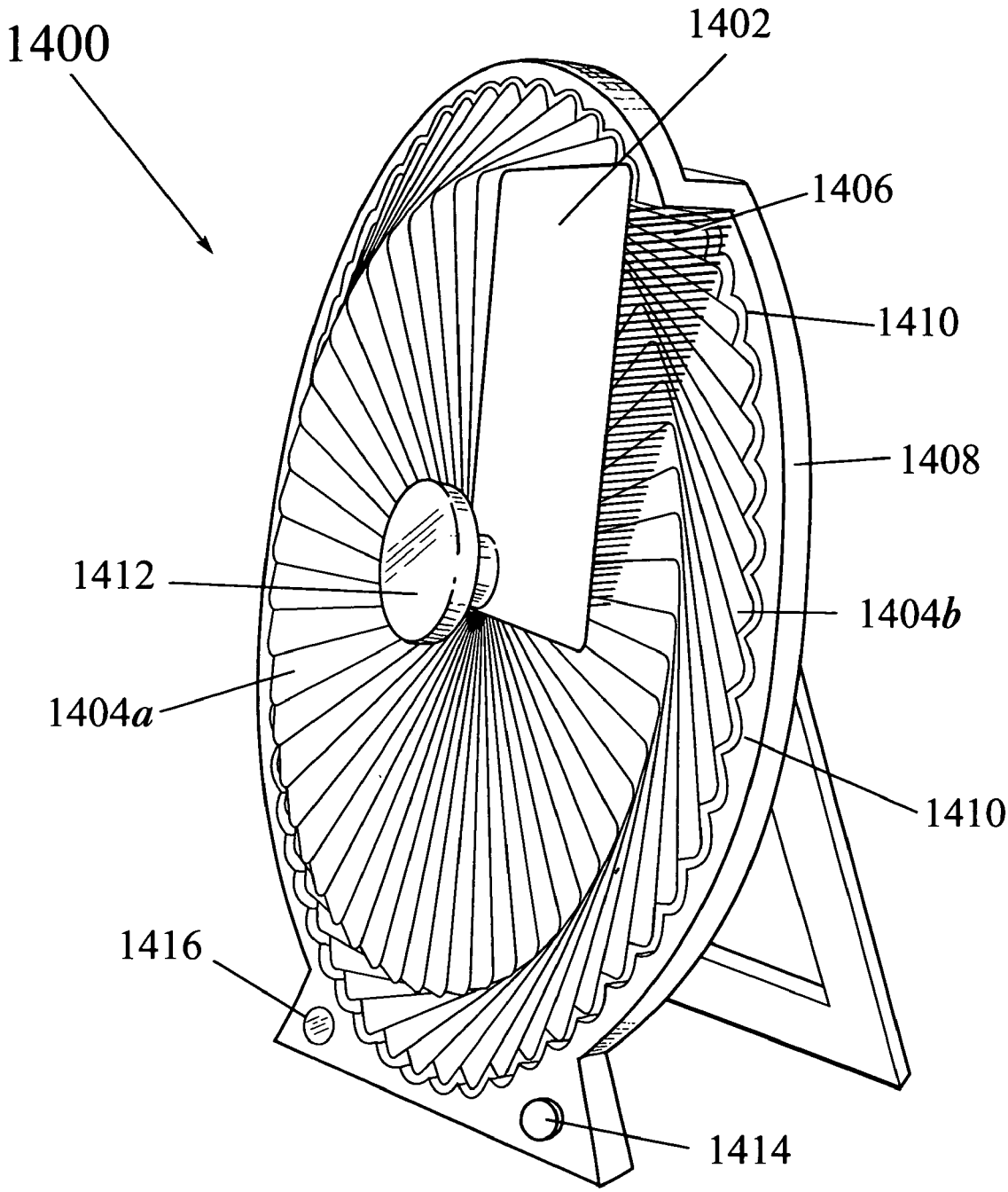
FIG. 14 depicts an angled, front view of an assembled card game in accordance with one embodiment of the present invention including cards, knob, and a stand having an integral base and multiple anchor points.

Turning next to FIG. 14, depicted is card game 1400, which is an alternate embodiment of the present invention substantially equivalent to the embodiment discussed above with respect to FIGS. 12-13. However, whereas the embodiment depicted in FIGS. 12-13 has two anchor points for the topmost card only, or for the topmost card, base card, and a few intermediate cards only, the embodiment of the present invention depicted in FIGS. 14, 15, 16A, and 16B has two anchor points for each of the topmost, base, intermediate cards 1402, 1404, and 1406, respectively.

Figure 15:
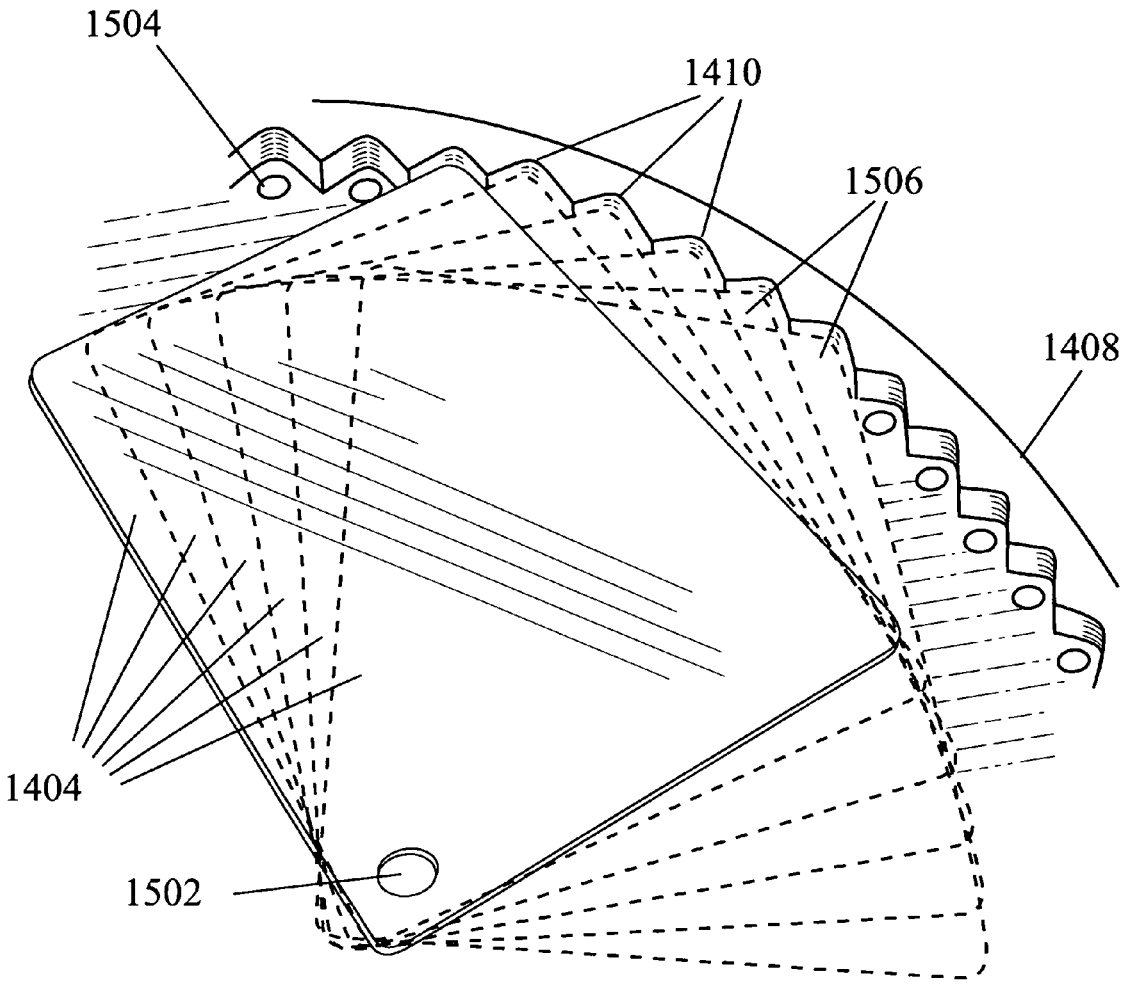
FIG. 15 depicts a magnified view of the stand, recesses, sensors, and anchoring of intermediate cards in accordance with the embodiment of the present invention depicted in FIG. 14.

First, each of topmost, intermediate, and base cards 1402, 1404, and 1406, respectively, are anchored to stand 1408 by inserting the upper right corner of such cards into a corresponding recess 1410 of stand 1408. An enlarged view of the nesting of several intermediate cards 1404 in recesses 1410 is illustrated in FIG. 15. Such insertion anchors each of these cards at a point opposite the second anchor point (i.e., the corner of the cards containing card aperture 1502). In one embodiment of the present invention, the inwardly facing surfaces of the recesses form a 90 degree angle with respect to each other to accommodate insertion of the corners of square or rectangular cards.

After all topmost, intermediate, and base cards 1402, 1404, and 1406, respectively, have been inserted in the corresponding recesses 1410 of stand 1408, topmost, intermediate, and base cards 1402, 1404, and 1406, respectively, are then anchored to stand 1408 via a mechanism such as knob 1412, or a knob and stop combination, as discussed in greater detail above with respect to FIG. 3. This anchoring allows topmost, intermediate, and base cards 1402, 1404, and 1406, respectively, to be fixed in an immovable position such that the entire face of topmost card 1402 and the visible areas of the faces of intermediate and base cards 1404 and 1406, respectively, can be viewed simultaneously. The totality of the face of topmost card 1402 and the exposed areas of the faces of intermediate and base cards 1404 and 1406, respectively, creates one larger coherent image as described in greater detail above with respect to FIGS. 4-11.

Referring now to FIG. 15, illustrated is a magnified view of stand 1408 including, inter alia, intermediate cards 1404, card apertures 1502, magnetic imprints 1506, and sensors 1504. Sensors 1504 are embedded in recesses 1410. Such sensors determine, by electronic or mechanical means, if the correct card has been placed in recess 1410. For example, in the embodiment of the present invention depicted in FIG. 15, sensors 1504 are magnetic sensors that read, or are activated by, magnetic imprints 1506 included in the surface of, or embedded within, the corners of topmost, intermediary and base cards 1402, 1404, and 1406, respectively. These sensors allow the correctness of the inserted cards to be ascertained at any time by pressing button 1414 (FIG. 14), or a similar switch or trigger located on stand 1408, which causes indicator 1416 (FIG. 14) to indicate the accuracy of the inserted cards. Although FIG. 15 discloses an electromagnetic system for detecting and indicating the correctness of inserted cards, other detection and indication may be substituted without departing from the scope of the present invention.

Figure 16A:
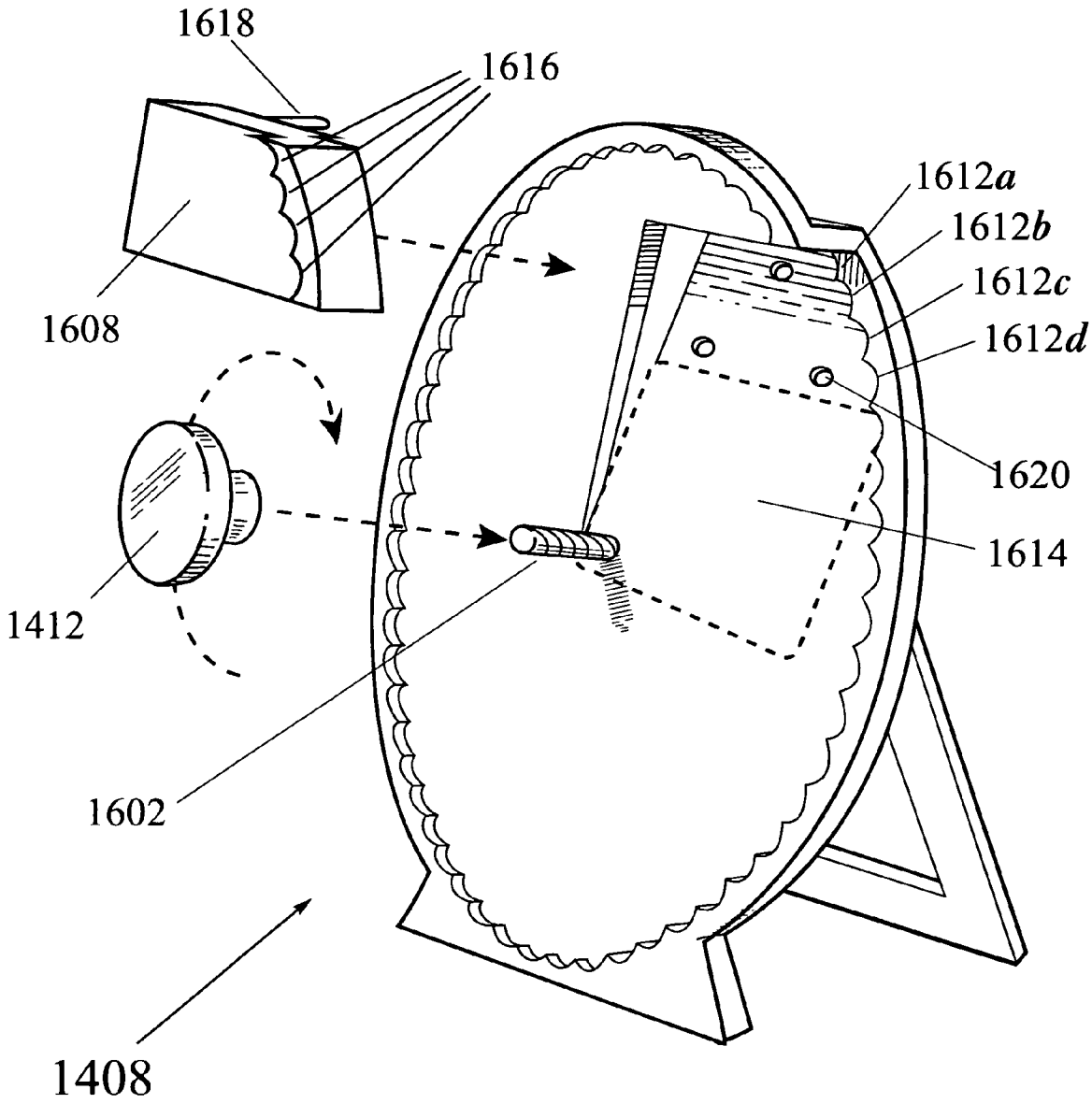
FIG. 16A depicts an angled, front view of the stand illustrated in FIG. 14 with the cards removed in accordance with one embodiment of the present invention including, inter alia, an exploded view of a knob, stand and adaptor.

Referring next to FIG. 16A, depicted is an angled front view of stand 1408 without cards with an exploded view of adaptor 1608 and knob 1412. Adaptor 1608 increases the versatility of the card game such as card game 1400 by providing support for single aperture topmost, intermediate, and base cards 1402, 1404, and 1406, respectively, that are passed over post 1602 in a horizontal orientation (i.e., when the side of the card to be displayed in the final coherent image is facing toward the viewer and the card is oriented such that the aperture is located in the lower left corner of the card, the width of the card is greater than the height of the card) rather than a vertical orientation (i.e., when the side of the card to be displayed in the final coherent image is facing toward the viewer and the card is oriented such that the aperture is located in the lower left corner of the card, the height of the card is greater than the width of the card). In other words, attachment of adaptor 1608 to stand 1408 allows the cards to be passed over post 1602 such that the backs of each card are displayed rather than the faces. Such embodiments allow portions of a second coherent image to be included on the backs of all cards such that a player, at his or her option, may either assemble a first coherent image by combining the images on the faces of all cards or assemble a second coherent image by combining the images on the backs of all cards.

Figure 16B:
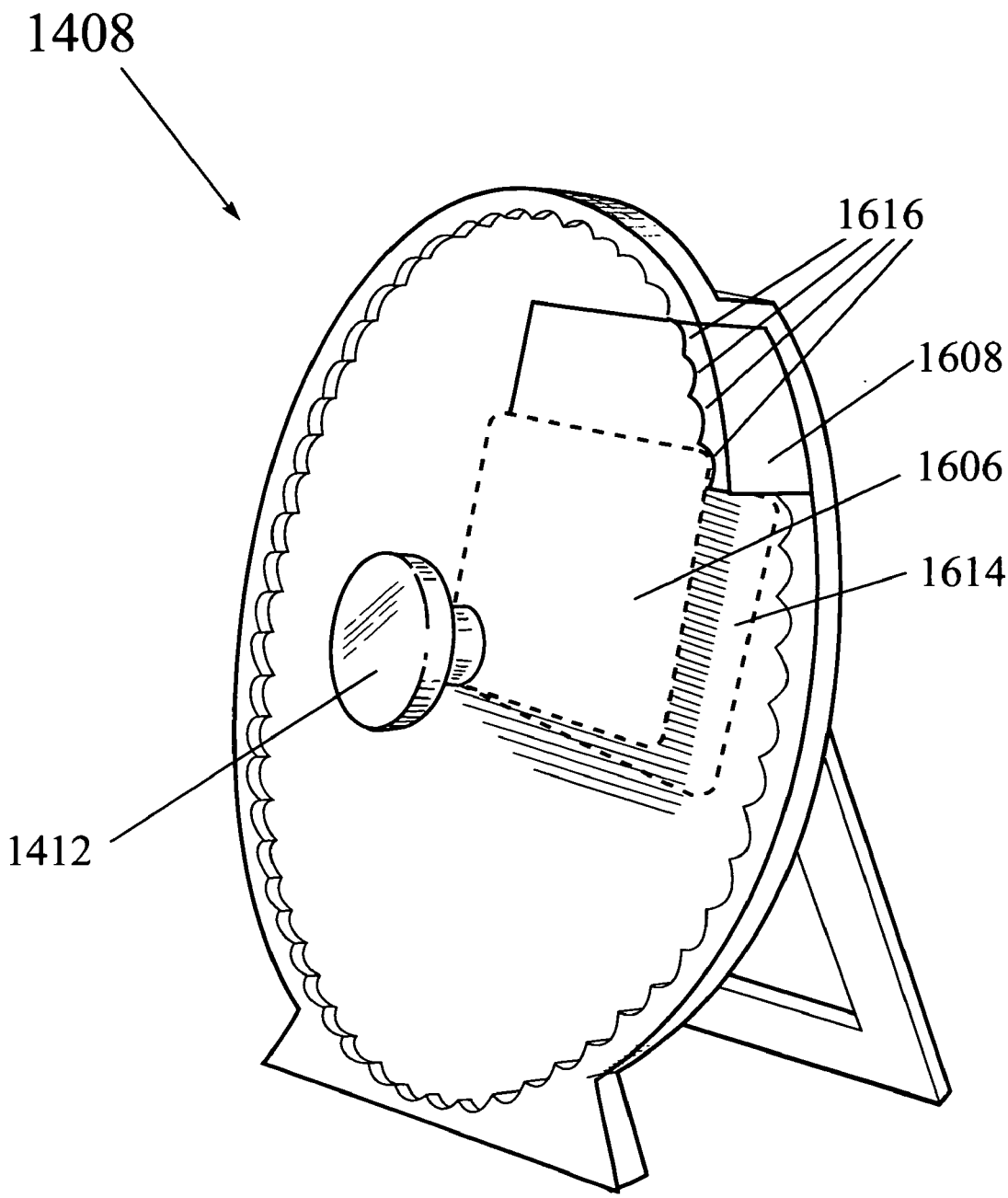
FIG. 16B depicts an angled, front view of the stand illustrated in FIG. 14 with the cards removed in accordance with one embodiment of the present invention including, inter alia, an assembled adaptor and knob, as well as indications of the locations of the base and topmost cards.

In the embodiment of the present invention depicted in FIGS. 16A and 16B, adaptor 1608 attaches to stand 1408 by inserting three adaptor pegs 1618 into three adaptor peg apertures 1620. However, alternate methods of attachment may be substituted without departing from the scope of the present invention. When all cards are assembled, knob 1412 may be attached to post 1602 as discussed above to further render the cards immovable. The quantity of adaptor recesses 1616 on adaptor 1608 may vary depending on factors such as the quantity of cards in the card game, the size and proportion of each card, etc. All such variations are within the scope of the present invention.

Although inclusion of adaptor 1608 is not required, it is preferred when installing the cards in a horizontal orientation to ensure that all cards have the necessary support. To illustrate this point, when assembling the cards in a vertical orientation, a player typically places a single aperture base card such as base card 1406 (FIG. 14) such that the aperture is located in the lower left corner of the card and the upper right corner of such base card nests into first recess 1612*a*. However, when a base card is placed in a horizontal orientation such as horizontally-oriented base card 1614, the orientation causes the base card to bypass first, second, third, and fourth recesses 1612*a*-1612*d*. Consequently, if adaptor 1608 is not attached to stand 1408, several of the cards that are placed atop stand 1408 at the end of the assembly, including the topmost card, will not have an appropriate recess 1612 into which a corner may be nested. This shortcoming may be remedied by attaching adaptor 1608 to stand 1408 whenever the cards are to be installed in a horizontal, rather than vertical, orientation to provide support and adaptor recesses 1616 for the final cards of the assembly.

FIG. 16B depicts an angled front view of stand 1408 with adaptor 1608 inserted into adaptor peg apertures 1620 (FIG. 16A). In the embodiment of the present invention depicted in FIG. 16B, the top edge of base card 1614 when it is in a horizontal orientation aligns with the bottom forward facing surface of adaptor 1608. Also depicted is the position of topmost card 1606 having one corner supported in adaptor recess 1616.

Figure 17:
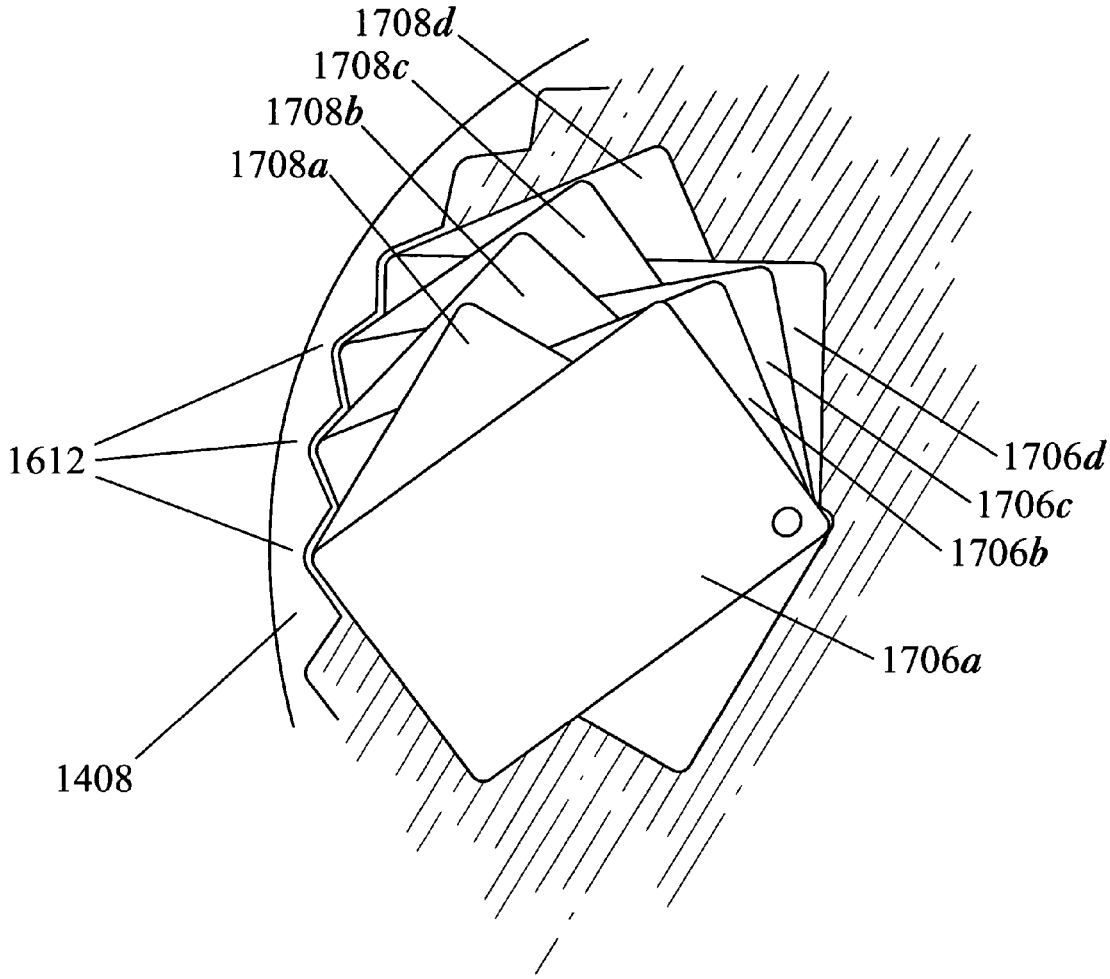
FIG. 17 depicts a magnified view of cards located in both horizontal and vertical orientations.

Turning now to FIG. 17, recesses 1612 having inwardly facing surfaces oriented at an angle greater than the 90 degree angle depicted for recesses 1410 (FIG. 15) are depicted. The greater angle is required on any plate, stand, or the like designed to allow the cards to be installed in either a horizontal or a vertical orientation. Horizontally-oriented intermediate cards 1706*a*-1706*d* and vertically-oriented intermediate cards 1708*a*-1708*d* are depicted to further illustrate the ability of the enlarged angle of the inwardly facing surfaces of recesses 1612 to accommodate both horizontally-oriented and vertically-oriented cards.

Figure 18:
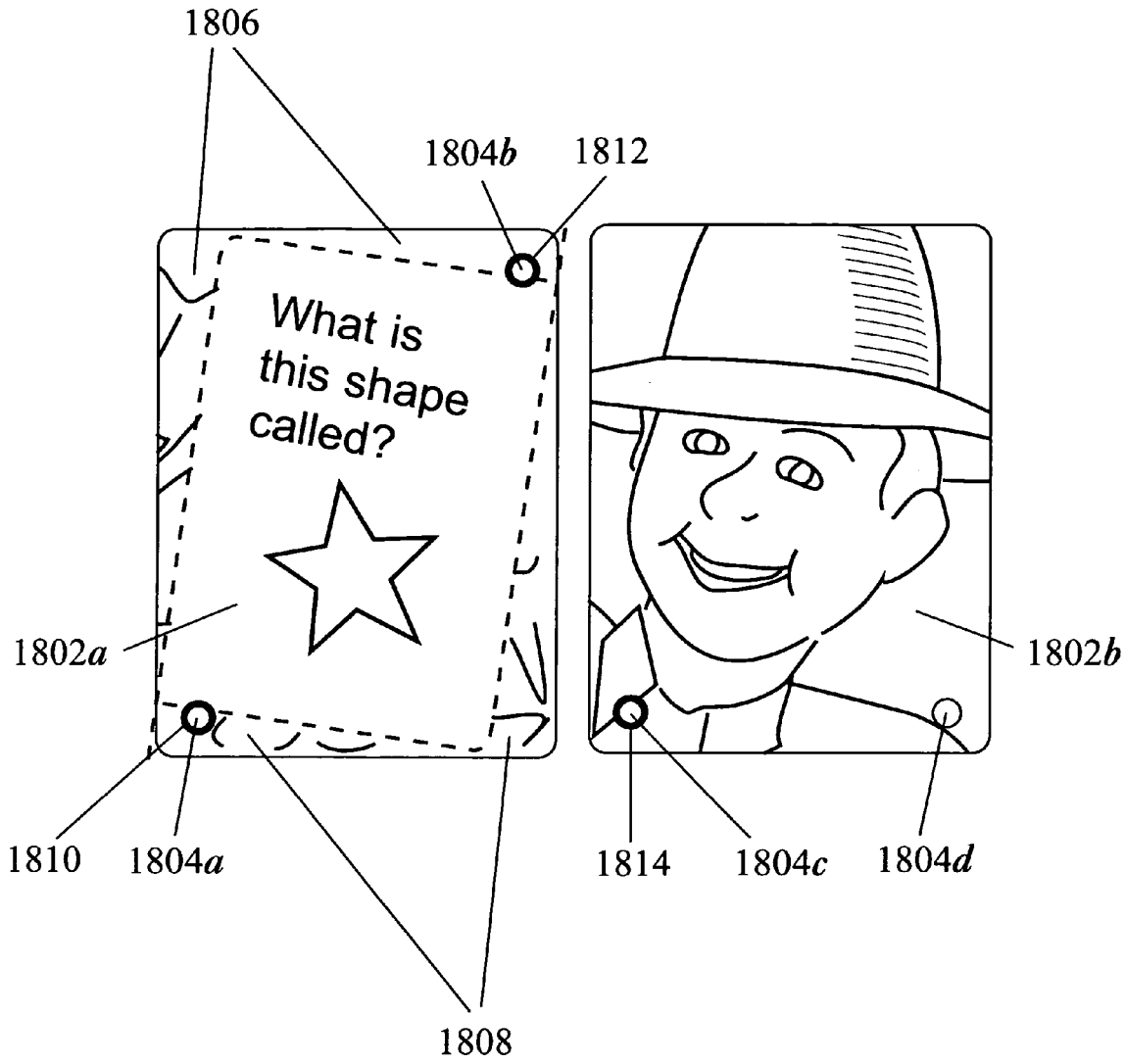
FIG. 18 depicts partially-figured and fully-figured embodiments of the present invention having double apertures in each card and dashed lines indicating the obscured portion of the partially-figured card.

Turning now to FIG. 18, depicted are partially-figured and fully-figured embodiments of the present invention including double apertures 1804 in each card and dashed lines indicating the obscured portion of the partially-figured card. Increasing the quantity of apertures 1804 increases the quantity of coherent images that may be created using a single deck of cards. Two examples are illustrated in further detail below with respect to cards 1802*a*-1802*b*, however, many more variations may be incorporated without departing from the scope of the present invention.

Card 1802*a* is a partially-figured card having two apertures 1804*a* and 1804*b* in diagonally opposed corners of card 1802*a*. A deck including a plurality of cards such as cards 1802*a* may be assembled in a vertical orientation using either of apertures 1804*a* and 1804*b* as an anchor point. However, use of apertures 1804*a* as anchoring points will result in the assembly of an image comprised of upper segments 1806, whereas use of apertures 1804*b* as anchoring points will result in the assembly of an image comprised of lower segments 1808. Consequently, assembly of a deck of cards such as cards 1802*a* in a vertical orientation may be performed to create either of two resulting coherent images. In addition, if the back of each card 1802*a* is also partially-configured (e.g., similar to the face of card 1802*a*), assembly of the backs of a deck of cards such as cards 1802*a* in a horizontal orientation using either apertures 1804*a* or 1804*b* as anchoring points may be performed to create either of two additional distinct resulting coherent images. In this manner, a single deck of cards such as cards 1802*a* may be assembled to create any one of four independent coherent images. Additionally, the hidden central sections of the faces and backs of each card 1802*a* may include information that is not a part of any resulting coherent image to enhance the utility of the card game as discussed above. For example, this area of each of the cards may depict one of the faces of a card in a standard deck of playing cards to allow cards 1802*a* to be used as such when they are not assembled.

Furthermore, card 1802*a* may optionally include codes, markings, or the like, such as color codes 1810 and 1812 to aid in assembly of the final coherent image. For example, as depicted in FIG. 18, color code 1810 may be a first color (e.g., red). Whenever the user intends to assemble a final coherent image that includes upper segments 1806, only apertures 1804*a* having color code 1810 shall be used as an anchoring point. Similarly, whenever the user intends to assemble a final coherent image that includes lower segments 1808, only apertures 1804*b* having color code 1812 (e.g., a blue color code) shall be used as an anchoring point.

Although card 1802*a* is depicted as partially-figured, such an aperture configuration may also be incorporated in a card having a fully-figured face and a partially-figured back, or a partially-figured face and a fully-figured back. When using a fully-figured card set, a quantity of different rotated versions of the resulting coherent image can be assembled that is equal to the quantity of cards in the deck,-since any fully-figured card may be selected as the base card as discussed above.

Card 1802*b* is a fully-figured card including two apertures 1804*c* and 1804*d* in both corners of a first end of card 1802*b*. If both the face and the back of cards 1802*b* are similarly configured, a deck of cards 1802*b* may be assembled to create a quantity of rotated coherent images equal to two times the quantity of cards 1802*b* in the deck. That is, each of the cards 1802*b* may be selected as the base card resulting in a quantity of coherent images equal to the quantity of cards as discussed above. As discussed above with respect to card 1802*a*, any combination of partially-figured and fully-figured card sides may be substituted without departing from the scope of the present invention.

In embodiments of the present invention such as that depicted in FIG. 18, cards 1802*b* may include a code, marking, or the like to indicate which apertures may be used in conjunction with a specific side (i.e., face or back) of a card. For example, color code 1814 located around the perimeter of aperture 1804*c* may indicate that aperture 1804*c* is an acceptable anchoring point for the side of card 1802*b* depicted in FIG. 18. Likewise, the absence of a color code around the perimeter of aperture 1804*d* indicates that it is not an acceptable anchoring point for the fully-figured side of card 1802*b* depicted in FIG. 18.

Although FIG. 18 depicts cards having two apertures, any quantity of apertures may be substituted without departing from the scope of the present invention. Also, embodiments of the present invention are envisioned in which some cards are horizontally-oriented and others are vertically-oriented to achieve a particular coherent image. Such embodiments may provide opportunities to increase the difficulty and therefore the entertainment value of the present invention. Furthermore, although cards are depicted, virtually any other type of segment (e.g., puzzle pieces, blocks, photos, etc.) may be substituted without departing from the scope hereof.

Figure 19:
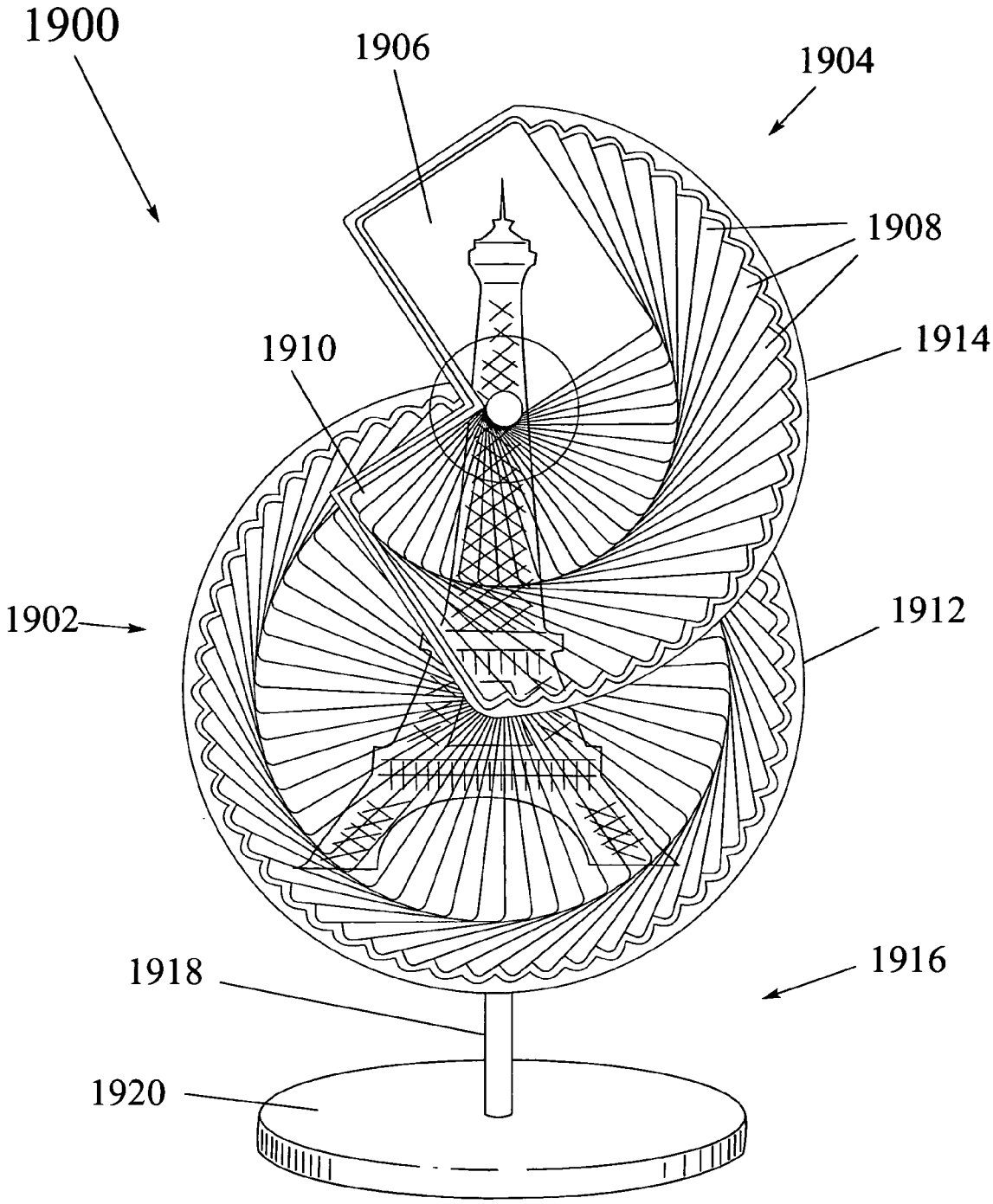
FIG. 19 depicts a front view of an assembled card game having primary and secondary card games in accordance with another embodiment of the present invention including, inter alia, primary and secondary card games, base, and shaft.

FIG. 19 depicts a front view of card game 1900 in accordance with another alternate embodiment of the present invention. Card game 1900 is similar in function to card game 1400 except that it includes both a primary card game 1902, as well as a secondary card game 1904. Both primary card game 1902 and secondary card game 1904 have two anchoring points for all primary topmost, intermediate, and base cards 2002, 2004, and 2006, respectively (FIG. 20B), and all secondary topmost, intermediate, and base cards 1906, 1908, and 1910, respectively. The two anchoring points for each of such cards are similar to those described above with respect to FIGS. 14 and 15.

Figure 20A:
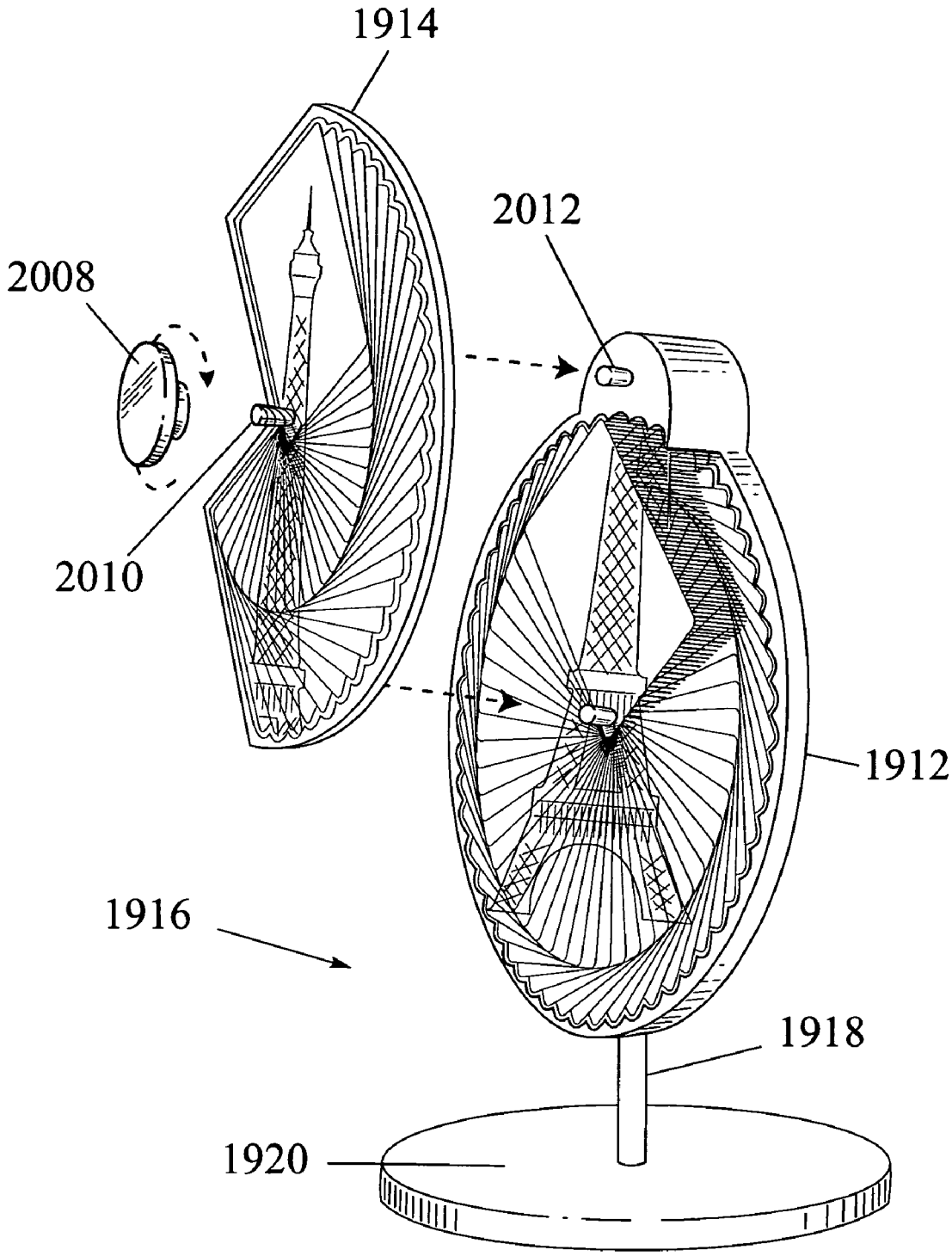
FIG. 20A depicts an angled front view of an assembled primary card game in accordance with the embodiment of the present invention illustrated in FIG. 19 including, inter alia, an exploded view of an assembled secondary card game and knob.
Figure 20B:
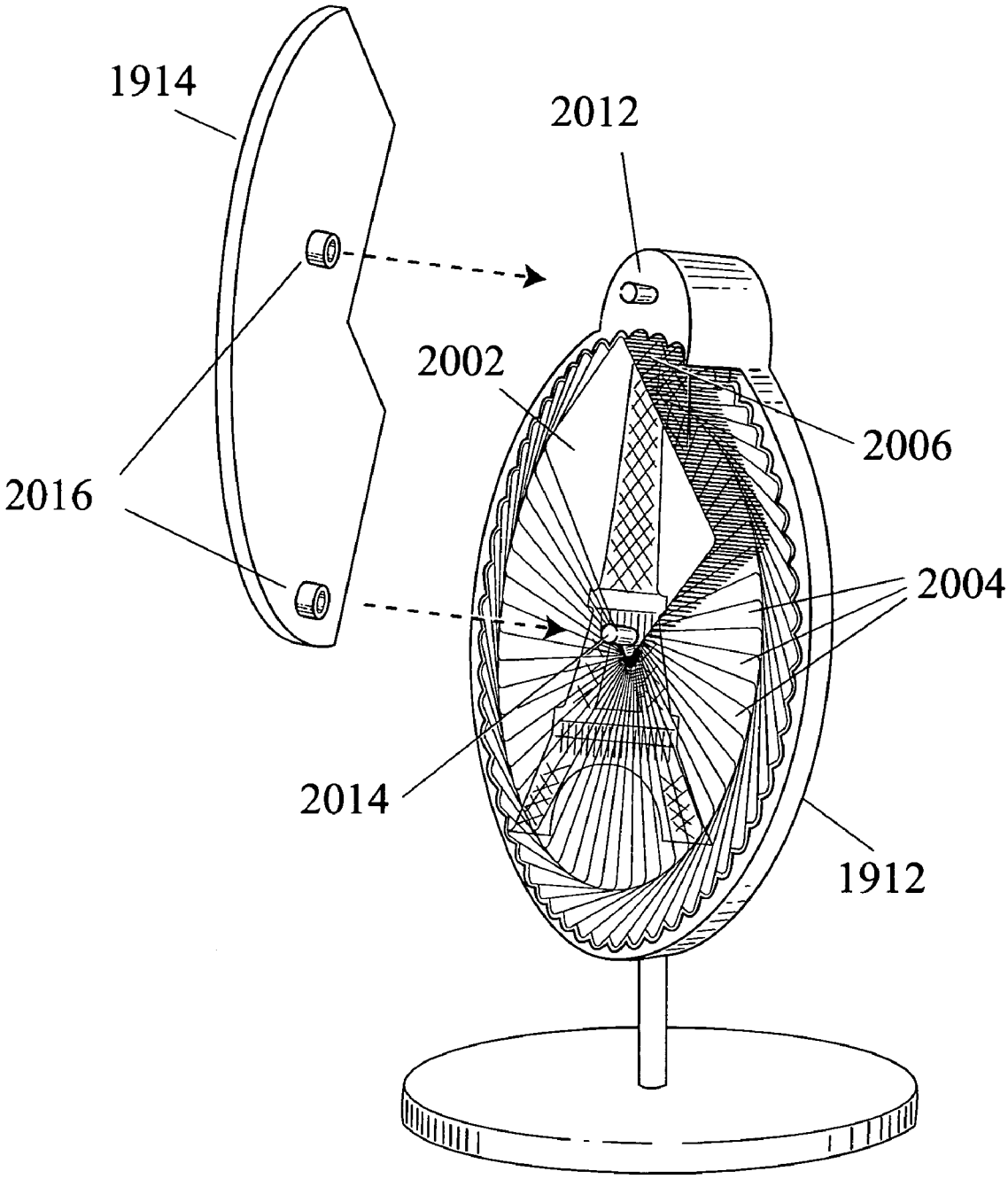
FIG. 20B depicts an angled front view of an assembled primary card game in accordance with the embodiment of the present invention illustrated in FIG. 19 including, inter alia, an exploded view of the back of the plate of a secondary card game.

To assemble card game 1900, first primary card game 1902 is assembled atop primary plate 1912 in the same manner described above with respect to FIGS. 14 and 15, except that there is no knob similar to knob 1412. The purpose of knob 1412 is achieved by attaching secondary plate 1914 to primary plate 1912. Next, an empty secondary plate 1914 is attached to primary plate 1912 as depicted in FIGS. 20A and 20B. As illustrated in FIGS. 20A and 20B, to perform such attachment, secondary plate apertures 2016, located on the rear side of secondary plate 1914, are passed over primary posts 2012 and 2014. Thereafter, secondary plate 1914 is maintained in this position relative to primary plate 1912 due to friction, gravity, and/or the inclined nature of primary plate 1912 when affixed atop stand 1916. Similar to stand 200 as discussed above with respect to FIG. 2, stand 1916 includes shaft 1918 and base 1920.

After attachment of secondary plate 1914 to primary plate 1912, all secondary topmost, intermediate, and base cards 1906, 1908, and 1910, respectively, may be assembled atop secondary plate 1914 in the same manner described above with respect to FIGS. 14 and 15, except that the cards are progressively stacked in a counterclockwise direction with respect to the center of secondary plate 1914. After completion of assembly of the secondary cards, knob 2008 may be tightly threaded onto secondary post 2010 to maintain secondary topmost, intermediate, and base cards 1906, 1908, and

1910, respectively, in an immovable state, thereby maintaining the single coherent image created by assembly of primary topmost, intermediate, and base cards 2002, 2004, and 2006, respectively, and secondary topmost, intermediate, and base cards 1906, 1908, and 1910, respectively.

Although, secondary plate 1914 is depicted as a half circle with four straight edges completing the non-circular half of secondary plate 1914, virtually any shape may be incorporated for primary plate 1912 and secondary plate 1914 without departing from the scope of the present invention. For example, either or both of primary plate 1912 and secondary plate 1914 could be shaped as a full circle, a semicircle, a polygon, etc. without departing from the scope of the present invention.

The stacking of two or more plates, wherein each plate contains a distinct array of cards in its assembled state, provides numerous advantages to the card game of the present invention. First, the addition of second, third, fourth, etc. sets of cards increases the complexity of the card game. The increase in the quantity of cards requires a player of the card game to potentially test and evaluate many additional cards before finding the next piece of the puzzle. Second, the increased complexity of the card game may add to increased enjoyment during assembly of the card game. Third, the added complexity of the resulting arrays of cards may provide enhanced visual satisfaction.

For example, in the embodiment of the present invention depicted in FIG. 19, beyond the addition of secondary plate 1914, card game 1900 is also designed such that primary topmost, intermediate, and base cards, 2002, 2004, and 2006, respectively, assembled on primary plate 1912 are assembled in a clockwise manner, whereas secondary topmost, intermediate, and base cards, 1906, 1908, and 1910, respectively, assembled on secondary plate 1914, are assembled in a counterclockwise manner. These two competing directions provide another aspect of the present invention that adds to the visual enjoyment and complexity of the resulting array of cards. Furthermore, in a satisfying visual surprise, this reversal of direction also modifies the configuration of the primary and secondary topmost, intermediate, and base cards such that the central circular area of the array of cards atop primary plate 1912 is larger than the central circular area of the array of cards atop secondary plate 1914. In alternate embodiments, the directions of the arrays of each set of cards may be reversed without departing from the spirit of the present invention.

While the present invention has been described with reference to one or more embodiments, which embodiments have been set forth in considerable detail for the purposes of making a complete disclosure of the invention, such embodiments are merely exemplary and are not intended to be limiting or represent an exhaustive enumeration of all aspects of the invention. The scope of the invention, therefore, shall be defined solely by the following claims. Further, it will be apparent to those of skill in the art that numerous changes may be made in such details without departing from the spirit and the principles of the invention.

The invention claimed is:

1. A game apparatus comprising:

at least one support, said support including at least one face, said at least one face including at least two recesses arranged radially about said face in at least one a group consisting of a clockwise direction of said face and a counterclockwise direction of said face, each of said at least two recesses being progressively more shallow than a preceding one of said at least two recesses along at least one of the group consisting of said clockwise direction of said face and said counterclockwise direction of said face;

at least one post protruding from said at least one face of said at least one support, said at least one post attached to said at least one support at a proximal end of said at least one post; and at least two segments, each of said at least two segments including at least one segment aperture configured to mate with said at least one post, each of said at least two segments including at least one subsection of at least one resultant image;

wherein overlapping each of said at least two segments in at least one predetermined orientation combines said at least one subsection to form said at least one resultant image.

2. An apparatus according to claim 1, wherein each of said at least two segments has at least two sides; and wherein said at least two segments are positioned such that a first of said at least two sides face a same direction.

3. An apparatus according to claim 1, wherein a first side of each of said at least two segments includes a first of said at least one subsection of a first of said at least one resultant image; and wherein a second side of each of said at least two segments includes a second of said at least one subsection of a second of said at least one resultant image.

4. An apparatus according to claim 1, wherein said at least two segments are a cards.

5. An apparatus according to claim 1, a first of said at least one subsection is located on a first side of each of said at least two segments;

wherein said first of said at least one subsection is visible in a first of said at least one resultant image when said at least two segments are assembled in a first position;

wherein a second of said at least one subsection is located on a second side of each of said at least two segments; and wherein said second of said at least one subsection is visible in a second of said at least one resultant image when said at least two segments are assembled in a second position.

6. An apparatus according to claim 5, wherein each of said at least two segments includes an obscured portion;

wherein said obscured portion does not include said first of said at least one subsection; and wherein said obscured portion does not include said second of said at least one subsection.

7. An apparatus according to claim 6, wherein said obscured portion of each of said at least two segments is at least one of the group consisting of blank, a playing card face, a face of a card of a special deck of cards, a trivia card face, and a flash card face.

8. An apparatus according to claim 1, wherein said at least one segment aperture is coded to aid a player in assembling at least one of said at least one resultant image.

9. An apparatus according to claim 8, wherein said coding of said at least one segment aperture is color coding.

10. An apparatus according to claim 1, said apparatus further comprising:

at least one recess lip located in at least one of said at least two recesses.

11. An apparatus according to claim 1, said apparatus further comprising:

at least one suspension mechanism.

12. An apparatus according to claim 11, wherein said at least one suspension mechanism is an aperture located in said support.

13. An apparatus according to claim 1, said apparatus further comprising:

at least one locking device.

14. An apparatus according to claim 13, wherein said at least one locking device is at least one of the group consisting of a knob, a stop, compressive stress, and a cap.

15. An apparatus according to claim 13, said apparatus further comprising:

at least one locking device lip located in said locking device.

16. An apparatus according to claim 13, wherein said at least one locking device is at least one of the group consisting of a knob, a stop, and combinations thereof; and wherein tightening of said at least one locking device to a longitudinal end of a post renders said at least two segments immovable.

17. An apparatus according to claim 16, wherein said at least one locking device and said at least one post are inversely threaded.

18. An apparatus according to claim 16, wherein said at least one stop includes at least one stop aperture for passing said at least one stop over said at least one post; and wherein proper positioning of said at least one stop atop said at least two segments mounted to said at least one support aids in maintaining said at least two segments in an immovable state.

19. An apparatus according to claim 16, wherein a material of at least one of the group consisting of said at least one stop and said at least one knob is at least one of the group consisting of rubber, a transparent material, and combinations thereof.

20. An apparatus according to claim 1, said apparatus further comprising:

at least one stand;

wherein said at least one stand allows said apparatus to be supported on a horizontal surface; and wherein said at least one stand is at least one of the group consisting of an integral stand and a removable stand.

21. An apparatus according to claim 1, wherein at least one side of each of said at least two segments includes at least one of the group consisting of a portion of said at least one resultant image and information unrelated to said at least one resultant image combined with said portion of said at least one resultant image.

22. An apparatus according to claim 1, wherein at least one of said at least two segments includes at least one obscured portion; and wherein said at least one obscured portion is not visible in at least one of said at least one resultant image.

23. An apparatus according to claim 22, wherein said at least one obscured portion is at least one of the group consisting of blank, a playing card face, a face of a card of a special deck of cards, a trivia card face, and a flash card face.

24. An apparatus according to claim 22, wherein said apparatus includes fifty-two of said at least two segments;

wherein said fifty-two of said at least two segments are shaped as playing cards; and wherein each of said at least one obscured portion of said fifty-two of said at least two segments corresponds to each one of fifty-two faces of a deck of said playing cards.

25. An apparatus according to claim 22, wherein said apparatus includes fifty-four of said at least two segments;

wherein said fifty-four of said at least two segments are shaped as playing cards;

wherein each of said at least one obscured portion of fifty-two of said fifty four of said at least two segments corresponds to each one of fifty-two faces of a deck of said playing cards; and wherein at least one of the group consisting of said at least one obscured portion and a full side of two of said fifty four of said at least two segments represent jokers.

26. An apparatus according to claim 1, said apparatus further comprising:

at least one extension coupled to said at least one support, said at least one extension encircling at least a portion of said at least two segments.

27. An apparatus according to claim 26, said apparatus further comprising:

at least one extension recess located in said at least one extension.

28. An apparatus according to claim 27, wherein said at least one extension recess facilitates mounting said at least two segments in at least two orientations within said at least one extension recess.

29. An apparatus according to claim 28, wherein said at least two orientations include a horizontal orientation and a vertical orientation.

30. An apparatus according to claim 1, wherein said at least one resultant image has a configuration of at least one of the group consisting of circular, varied, rectangular, and multi-tiered.

31. An apparatus according to claim 1, wherein said at least one support has a configuration selected from the group consisting of circular, rectangular, and multi-tiered.

32. An apparatus according to claim 1, said apparatus further comprising:

at least one cover.

33. An apparatus according to claim 1, wherein said at least two segments include at least one standardized edge.

34. An apparatus according to claim 33, wherein a first of said at least two segments is matched to a second of said at least two segments along at least one of said at least one standardized edge.

35. An apparatus according to claim 1, wherein at least one side of each of said at least two segments includes a portion of said at least one resultant image;

wherein any one of said at least two segments may be positioned as a base segment; and wherein said at least one resultant image created by said apparatus varies in relation to said one of said at least two segments positioned as said base segment.

36. A game apparatus comprising:

at least two segments, each of said at least two segments including at least one subsection of at least one resultant image;

a plurality of segment apertures bored through each of said at least two segments;

at least one support; and a plurality of posts coupled to said at least one support; a first of said plurality of posts protruding from a first of said at least one support, a second of said at least one support is removably mountable atop said first of said plurality of posts such that said second of said at least one support supports a second set of said at least two segments, a second of said plurality of posts protruding from said second of said at least one support;

wherein overlapping each of said at least two segments in at least one predetermined orientation combines said at least one subsection to form said at least one resultant image;

wherein passing each of said plurality of segment apertures of a first set of said at least two segments over said first of said plurality of posts mounts said first set atop said first of said at least one support;

wherein passing each of said plurality of segment apertures of a second set of said at least two segments over said second of said plurality of posts mounts said second set atop said second of said at least one support;

wherein passing each of said plurality of segment apertures over said first and second of said plurality of posts aids a player with at least one of a group consisting of overlapping said first and second set of said at least two segments, orienting said first and second set of said at least two segments, and affixing said first and second set of said at least two segments; and wherein said apparatus is multi-tiered.

37. An apparatus according to claim 36, wherein said at least two segments mounted to said first of said at least one support are assembled in a first direction; and wherein said at least two segments mounted to said second of said at least one support are assembled in a second direction.

38. An apparatus according to claim 37, wherein said first direction is clockwise and said second direction is counterclockwise.

39. An apparatus according to claim 37, wherein said first direction is counterclockwise and said second direction is clockwise.

* * * * *